US008006420B2

(12) United States Patent
Merner et al.

(10) Patent No.: US 8,006,420 B2
(45) Date of Patent: Aug. 30, 2011

(54) RETRACTABLE BANNER DISPLAY STAND

(75) Inventors: Lyle D. Merner, Richmond (CA); Gabriela P. Merner, legal representative, Richmond (CA); James T. I. Landecker, Vancouver (CA)

(73) Assignees: The Portables Exhibit Systems Limited, Richmond, British Columbia (CA); Downing Displays, Inc., Milford, OH (US)

( * ) Notice: Subject to any disclaimer, the term of this patent is extended or adjusted under 35 U.S.C. 154(b) by 258 days.

(21) Appl. No.: 12/199,027

(22) Filed: Aug. 27, 2008

(65) Prior Publication Data

US 2010/0050489 A1 Mar. 4, 2010

(51) Int. Cl.
*G09F 17/00* (2006.01)

(52) U.S. Cl. ..... 40/604; 40/514; 40/606.18; 160/24

(58) Field of Classification Search ..... 40/604, 40/603, 610, 606.01, 607.1, 606.18
See application file for complete search history.

(56) References Cited

U.S. PATENT DOCUMENTS

| | | | | |
|---|---|---|---|---|
| 1,443,695 | A * | 1/1923 | McKibbin | 160/24 |
| 1,974,076 | A | 5/1931 | Lindenberger | |
| D339,168 | S | 9/1993 | Gerhart et al. | |
| 5,798,861 | A | 8/1998 | Doat | |
| D406,275 | S | 3/1999 | Wright | |
| 5,983,545 | A | 11/1999 | Marco | |
| 6,115,951 | A | 9/2000 | Jing et al. | |
| 6,182,938 | B1 | 2/2001 | Wright | |
| 6,457,684 | B1 | 10/2002 | McKendry | |
| D468,362 | S | 1/2003 | Zarelius | |
| 6,571,496 | B2 | 6/2003 | Zarelius | |
| 6,643,966 | B2 | 11/2003 | Schmitt | |
| D483,412 | S | 12/2003 | Lang | |
| D483,413 | S | 12/2003 | Merenlender | |
| D497,955 | S | 11/2004 | Lang | |
| 6,836,988 | B2 | 1/2005 | Zarelius | |
| 7,040,372 | B2 | 5/2006 | Johansson et al. | |
| 7,237,350 | B1 | 7/2007 | Zarelius | |
| D562,909 | S | 2/2008 | Meijer | |
| 7,337,567 | B2 | 3/2008 | Fritsche et al. | |
| D577,075 | S | 9/2008 | Bode | |
| D578,574 | S | 10/2008 | Lundgren | |

(Continued)

FOREIGN PATENT DOCUMENTS

KR 10-2005-0073156 A 7/2005

(Continued)

OTHER PUBLICATIONS

International Search Report and Written Opinion issued in counterpart PCT Application No. PCT/US2009/054116, mailed on Apr. 6, 2010 (9 pages).

(Continued)

*Primary Examiner* — Joanne Silbermann
*Assistant Examiner* — Kristina Staley
(74) *Attorney, Agent, or Firm* — Wood, Herron & Evans, LLP

(57) ABSTRACT

A retractable banner stand includes a canister with an extendable banner having an ad and/or message thereon viewable when the banner is extended. A kit comprised of a pair of end caps with foldable legs and a pole support are releasably engaged to the canister and can be removed without tools. The kit can be releasably engaged to a second canister, without tools, with the second canister containing a second banner with a different (or new) ad and/or message to thus facilitate changing banners.

38 Claims, 20 Drawing Sheets

U.S. PATENT DOCUMENTS

| | | | | |
|---|---|---|---|---|
| D592,706 | S | 5/2009 | Zarelius | |
| D592,707 | S | 5/2009 | Zarelius | |
| 2002/0050083 | A1 | 5/2002 | Zarelius | |
| 2005/0028943 | A1* | 2/2005 | Chang | 160/23.1 |
| 2005/0081413 | A1 | 4/2005 | Ko | |
| 2008/0005945 | A1* | 1/2008 | Fritsche et al. | 40/603 |
| 2008/0105797 | A1 | 5/2008 | Fritsche et al. | |
| 2009/0183408 | A1* | 7/2009 | Dicke | 40/610 |

FOREIGN PATENT DOCUMENTS

| | | | |
|---|---|---|---|
| KR | 10-2008-0012119 | A | 2/2008 |
| WO | 0047508 | | 8/2000 |

OTHER PUBLICATIONS

Skyline Banner Stand 3000 (6 pages) (copyright 2008).
Skyline Banner Stand 3000-R Specifications (2 pages) (copyright 2008).
Skyline Banner 3000-R Set Up (PN23107) (1 page) (copyright 2003).
Skyline Banner Stand 3000-R Double Sided (PN24983-A) (1 page) (copyright 2003).
Skyline Banner Stand 3000-R Exchange Graphic Replacement (PN24468) (1 page) (copyright 2003).
Skyline Reaction (TM) Banner Stand Unique Curved, Retractable Design (PN28419) (4 pages) (copyright 2005).
Skyline Banner Stand with Graphic Exchange System (PN25672) (4 pages) (copyright 2004).
Skyline Exalt(R) Banner Stand web ad page (1 page) (copyright 2008).
Skyline Exalt (TM) Curved Banner Stand Set-Up instructions (PN31578-A) (8 pages) (copyright 2007).
Skyline Exalt(TM) Convertible Stand Graphic Replacement (PN30631-B) (1 page) (copyright 2007).
Skyline Exalt Banner Stand Specifications (1 page) (copyright 2008).
Penguin Portable Displays web ad (2 pages).
Penguin Banner Stands—brochure (2 pages).

* cited by examiner

RETRACTABLE BANNER DISPLAY STAND

FIELD OF THE INVENTION

The present invention relates generally to retractable banner stands, and more particularly, to changing the banner thereof.

BACKGROUND OF THE INVENTION

Retractable banner stands are portable display systems with a banner having a viewable ad and/or message thereon extendably held within a canister, which might be a tubular metal cylinder. The banner is typically wound or coiled about an elongated spring mechanism or core extending within the canister and supported for rotation by end pieces closing off both ends of the canister. End caps may be fastened over the end pieces to provide a decorative cover and hide the mechanics of the device from view.

A pole is removably mounted to one side of the canister, mid-way between the ends of the canister. The pole provides a free end spaced above the canister. The upper edge of the banner is mounted to a top bar or profile which sits at the outer surface of the canister when the banner is rolled up within the canister. The top bar, or a handle affixed thereto, can be grasped to extend the banner out from the canister as the spring mechanism is wound up within the canister. The top bar is mounted to the free end of the pole to hold the banner in the extended position with the ad and/or message being viewable. To retract the banner into the canister, the top bar is demounted from the pole, and the spring mechanism causes the banner to be rolled back up into the canister.

To support the canister on a surface such as the floor or a table with the banner extended, supporting legs may extend from the bottom of the canister. The supporting legs may be rotatably mounted to the bottom of the canister so that, in use, they extend transverse to the canister, but can be rotated into a storage position aligned under the canister. With the pole removed, the canister and its legs present a compact unit suitable for transportation, such as in a carrying case or carry bag. The pole may be telescopically collapsible to fit within the case or bag as well.

It often becomes necessary for the users of these stands to provide a different ad and/or message, thus necessitating a different banner. In order to facilitate changing the banner, it is necessary to gain access to at least one of the end pieces by removing the end cap, which must then be reattached after the banner is changed out. Tools may be required to remove and reattach the end caps. The exposed end piece includes a radially extending slot aligned with the lower edge of the banner in the extended position of the banner. The banner must thus be pulled out and held in that extended position for removal. The banner is typically held extended by a clip with a projecting pin associated with an end piece and which has to be rotated into position to extend the pin through the end piece and into engagement with the core to prevent the spring mechanism from rewinding thus holding the banner in the extended position. The lower end of the banner may then be slid longitudinally out of the core and through the slot. A new banner may then be installed. Also, the upper edge of the old banner has to be demounted from the top bar and the new banner mounted thereto. The clip may then be manipulated to remove the pin and rotate it out of the way to thus allow the spring mechanism to wind up the new banner into the canister.

Many of the users of these retractable banner stands find it difficult to manipulate the various components in order to change the banner. As a result, they may send it back to a shop for banner replacement, which has cost and timing implications. Alternatively or additionally, some users may buy multiple banner stands, in order to have sufficient numbers of different banners available. That, too, has cost, as well as storage and inventory implications.

SUMMARY OF THE INVENTION

The present invention provides a retractable banner display system and method which simplifies banner changes in the field. To that end, and in accordance with the principles of the present invention, the supporting legs and end caps are combined, and the end caps are adapted to releasably engage to and disengage from the ends of the canister, all without tools, to thus provide not only the decorative and functional aspects of the prior end caps, but also the supporting legs. As a consequence, changing the banner can be easily accomplished by removing the end caps from a first canister having a first banner and attaching them to a second canister having a second, different banner. There is thus no need, in the field, to engage in the often-times complicated and difficult task of using tools to remove or reattach end caps, of manipulating a clip to hold the banner extended for change-out, of removing a banner from the stand and replacing it with a second banner, or of removing the banner from the top bar and mounting the top bar to the second banner. Additionally, there is no need to maintain an inventory of multiple banner stands, thereby eliminating the added cost, space and manipulation of legs associated with each such stand.

In accordance with a further aspect of the present invention, in some embodiments, instead of a pole support forming part of the canister, a separate pole support may be provided and which has gripping structure to releasably engage to and disengage from the canister, all without tools. The gripping structure may include a retractable hook adapted to releasably engage a hook receiver in a central aspect of the canister and a lever operatively coupled to the hook to selectively retract the hook. Advantageously, the pole support has a cradle on one end shaped to selectively receive the tubular canister to which the pole support is to be releasably engaged. The pole support may also include a projection, and advantageously a spring-biased projection, adapted to mate into a longitudinal groove in the pole to assist in orienting the pole. In the embodiments having the separate pole support, changing banners is accomplished with the further simple expedient of also removing the pole support from the first canister and attaching it to the second canister. Where the separate pole support is provided, the added cost and space of pole supports for each banner is also eliminated.

The end caps each advantageously include a central support element having an inner aspect which releasably engages the canister or at least a respective end piece thereof. For that purpose, the central support element inner aspect may include a retainer clip adapted to selectively engage an end piece. Legs extend from the central support in a common plane, but in opposite directions, transverse to the canister to thus support the canister when mounted thereto. Advantageously, the legs are foldably coupled to the central support element and may be folded into a storage position so as to extend in parallel, but spaced-apart planes along opposite sides of the canister. With the legs folded, the canister and end caps, and the pole support if attached, may be placed into a case or bag for storage or transit. Other banner canisters may also be available, but without the need for additional end caps, legs and/or pole supports. Advantageously, the legs and central support element have cooperating spring-biased detents which hold the legs in the folded and/or unfolded position.

In accordance with a yet further aspect of the present invention, a pair of the end caps and the separate pole support define a retractable banner display system kit. Thus, a customer may buy one kit, and multiple canisters each with a different banner, such that the desired banner may be displayed by coupling the kit components to the selected canister, all without the need to own multiple, complete banner stands for the multiple, different banners and without the need to change out the banner within the canister.

In some situations, it is desirable to display a second banner, along with the extended banner from the banner stand. One typical solution is to place two retractable banner stands in back-to-back relationship, and extending each banner from the canister of its respective stand. That, however, is costly and consumes support surface space, which may be at a premium in some display environments. To reduce the space required, a roll-up banner may be mounted adjacent the retractable banner stand. While roll-up banners take up less space, they still require their own supporting structure or frame, which adds cost and takes at least some space from the display area. To overcome such drawbacks, in accordance with an alternative aspect of the present invention, the pole support may include at least one, and advantageously two, banner tensioning receptacles to receive the tension cord associated with the bottom edge of a roll-up banner. In such embodiments, the top end of the roll-up banner may be supported on its own profile which is removably mounted to the top bar of the retractable banner stand so as to be mounted and demounted to the pole with the retractable banner, such that two banners may be displayed in the same space as the retractable banner stand, and without the additional cost or manipulation of further structure normally associated with roll-up banners.

The canisters used in the present invention may be generally like canisters previously used, although the end cap(s) and supporting leg(s) and, optionally, the pole support, need not be made part of or generally permanently secured to the canister such that tools are not required to remove same without damage. Thus, the spring mechanism may be held wound up with the banner extended, and the banner replaced through a slot in the end piece as before, if desired. Advantageously, however, the end pieces are modified to provide a channel with a lock element to which the retainer clip of the end caps may engage, and the end caps and end pieces are provided with mating slots and ledges to guide them together and to cooperate with the clip to releasably engage the end caps to the end pieces. Further, instead of a rotatable clip with a pin on one of the end pieces, a separate core locking pin(s) may be removably associated with one (or both) of the end caps, such as within the inner aspect of the central support element. In that regard, in one embodiment, the retaining clip includes a spring-slot into which the core locking pin may be removably mounted for storage. As a result, changing the banner no longer requires rotation and manipulation of a clip attached to the end piece, but simply removal of the holding clip from the end cap, which is then free to be easily inserted into and withdrawn from the end piece as necessary. The core locking pin, after use, is simply remounted to the spring-slot of the end cap.

By virtue of the foregoing, there is thus provided a retractable banner display system and method which simplifies banner changes in the field. These and other objects, advantages and features of the invention will become more readily apparent to those of ordinary skill in the art upon review of the following detailed description taken in conjunction with the accompanying drawings.

BRIEF DESCRIPTION OF THE DRAWINGS

The accompanying drawings, which are incorporated in and constitute a part of this specification, illustrate an embodiment of the invention and, together with a general description of the invention given above, and the detailed description given below, serve to explain the invention.

DETAILED DESCRIPTION OF THE DRAWINGS

Figure 1:
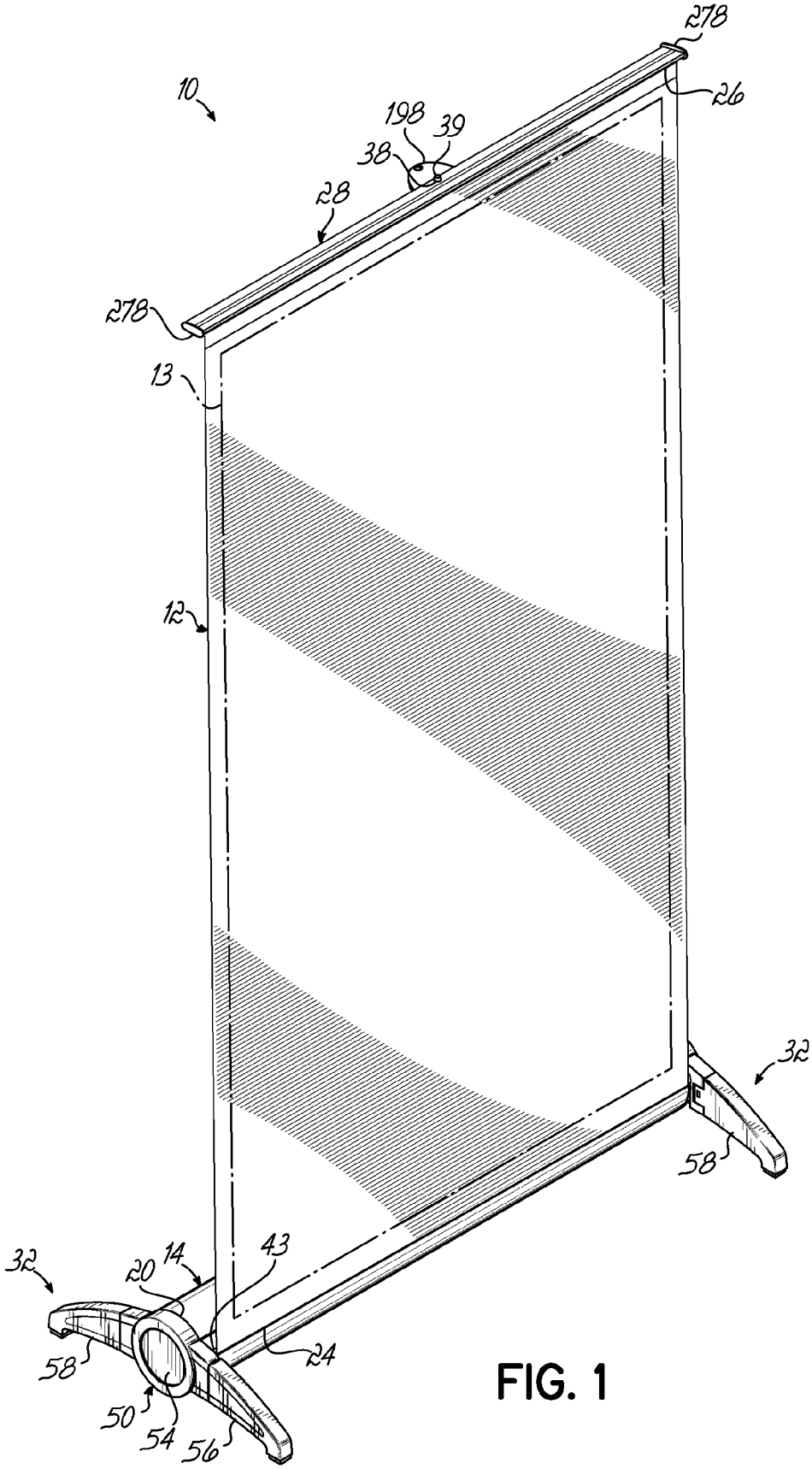
FIG. 1 is a front, perspective view of an exemplary embodiment of a retractable banner stand including a banner canister from which the banner is extended and to which the components of a retractable banner display system kit are engaged, and having a telescoping pole mounted in the pole support of the kit for holding the banner in the extended position all for purposes of explaining the principles of the present invention.
Figure 2:
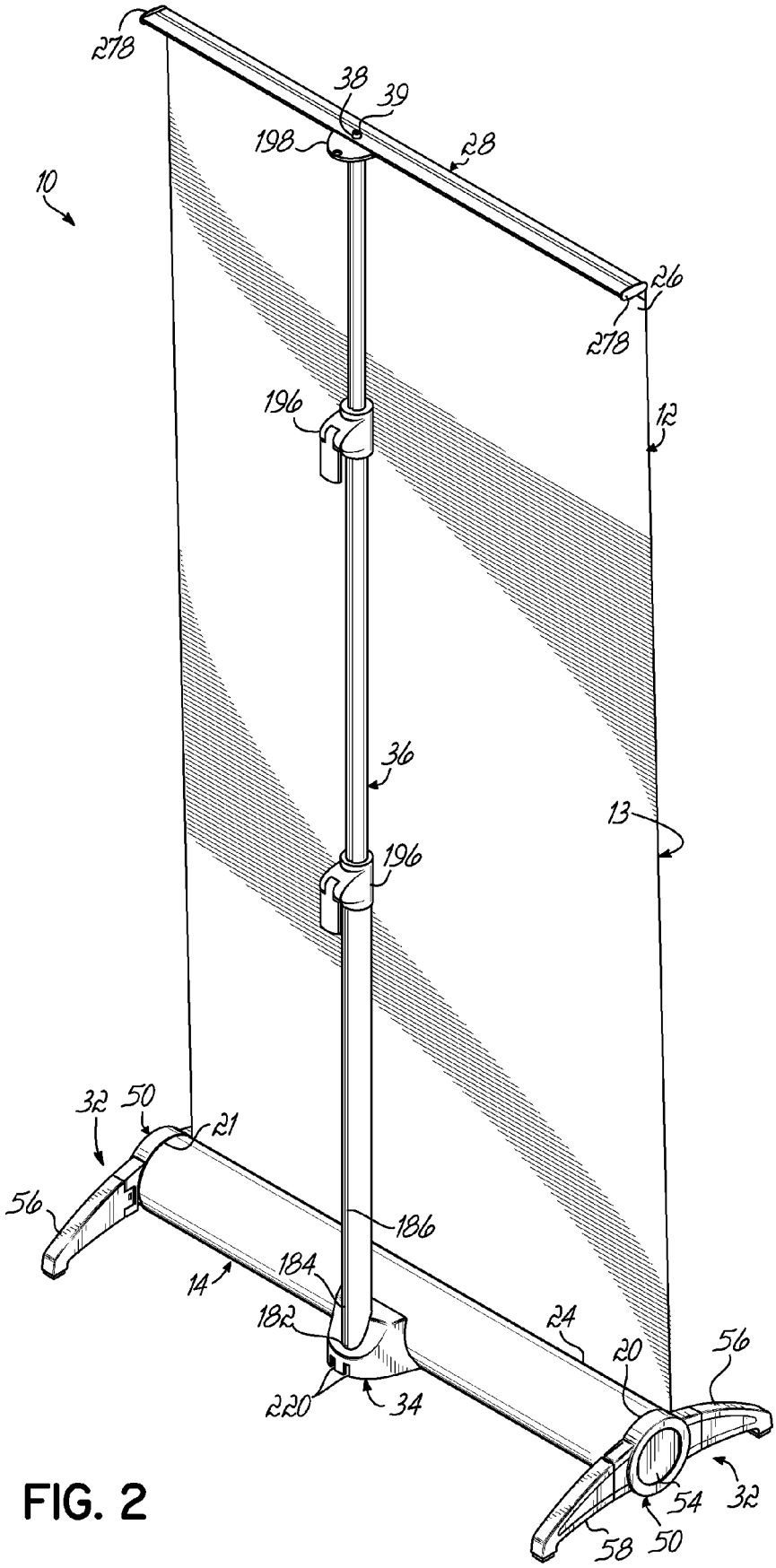
FIG. 2 is a rear perspective view of the retractable banner stand of FIG. 1.
Figure 3:
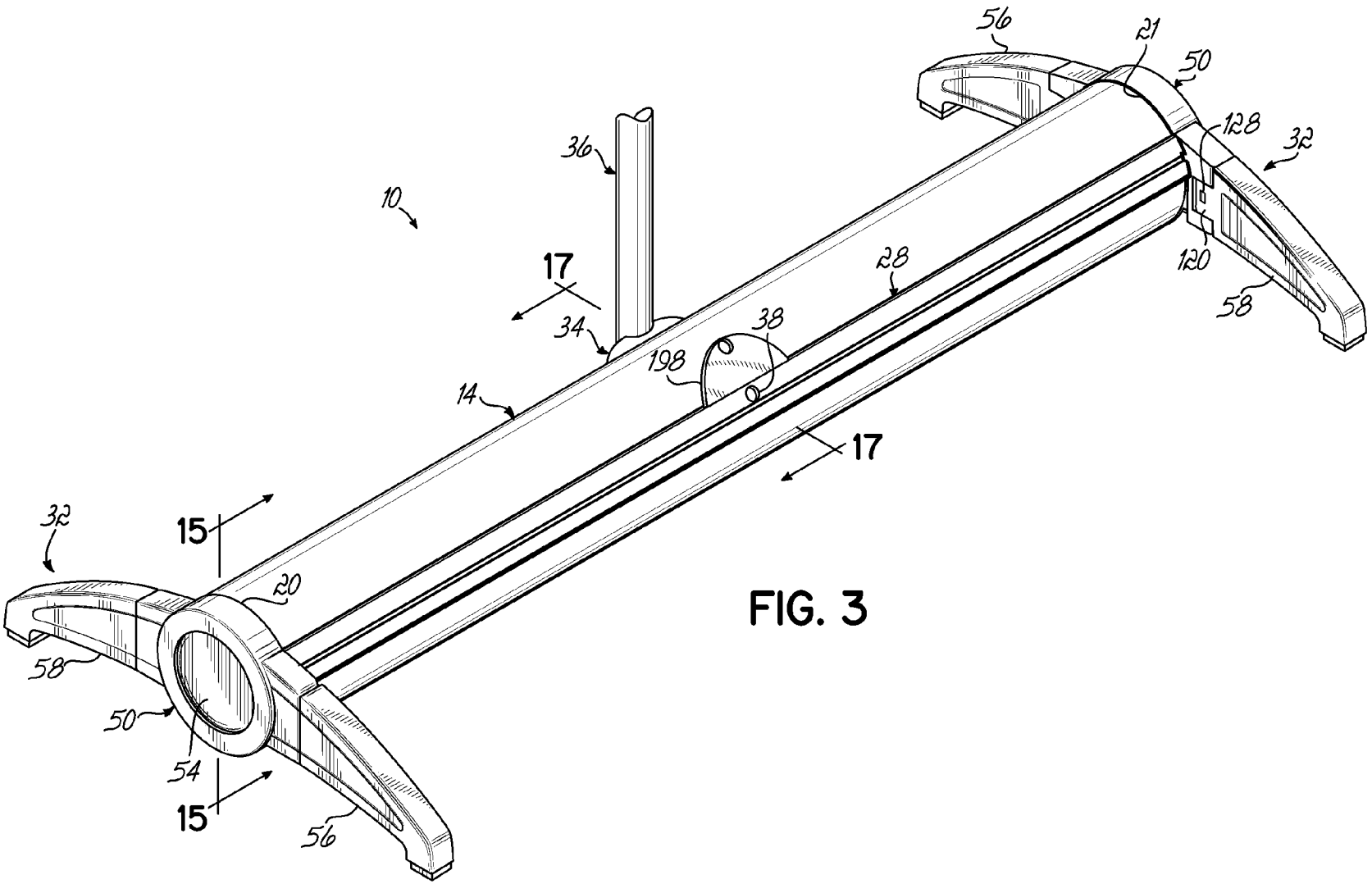
FIG. 3 is a front perspective, partial view of the retractable banner stand of FIG. 1 with the banner retracted.
Figure 4:
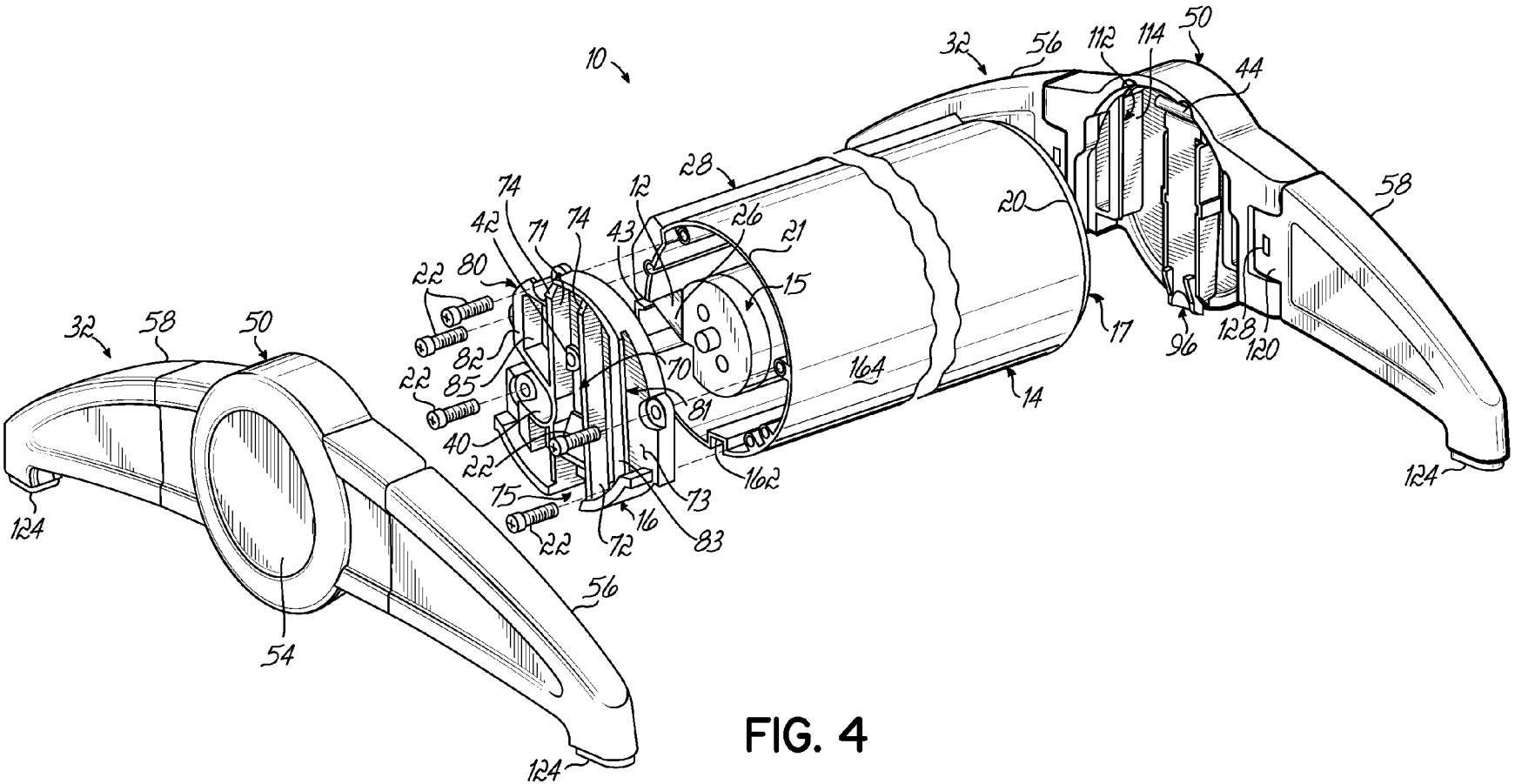
FIG. 4 is an exploded, partial view of the retractable banner stand of FIG. 1 with the banner retracted.
Figure 5:
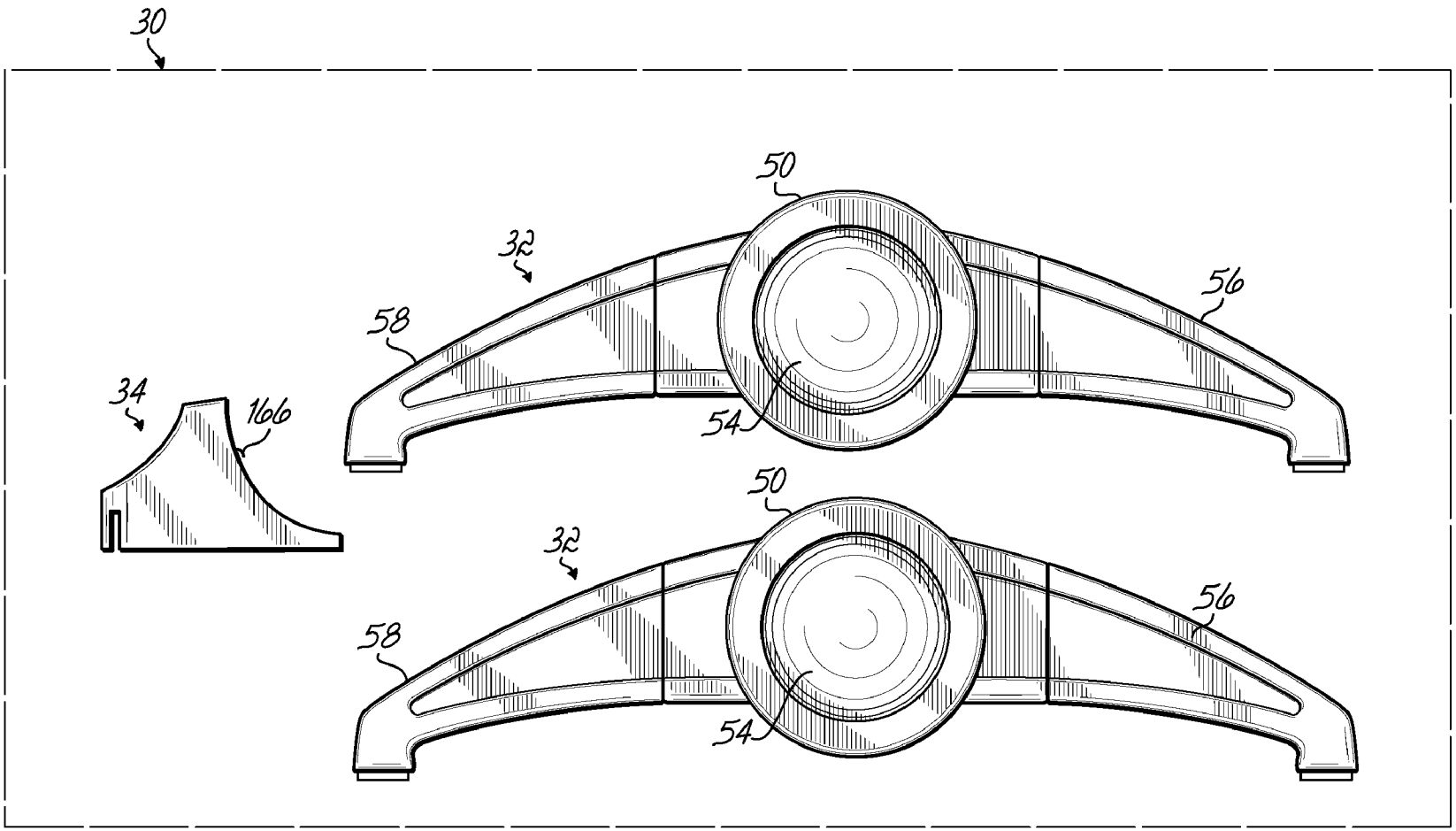
FIG. 5 is a side plan view of the retractable banner display system kit utilized in the retractable banner stand of FIG. 1.

With particular reference to FIGS. 1-5, there is shown an exemplary retractable banner stand 10 having an extendable banner 12 having a viewable ad and/or message 13 associated therewith, shown in the extended or display position in FIGS. 1, 2 and 4 for viewing of ad or message 13 and in the retracted position in FIG. 3 in which the ad and/or message 13 is not readily viewable. Banner stand 10 includes a banner canister 14 defined by a hollow interior metal or plastic cylinder which extendably holds banner 12 therein. A spring mechanism or core 15 (FIG. 4) is rotatably supported within canister 14, and held in place by end pieces 16, 17 affixed to respective, otherwise normally-open, opposite ends 20, 21 of canister 14, such as with screws or bolts 22 (FIG. 3). Banner 12 is affixed at its lower edge 24 to core 15, and at its upper edge or free end 26 to top bar 28 which normally seats against canister 14 when banner 12 is not extended (FIG. 4).

Banner stand 10 also includes retractable banner display system kit 30 (FIG. 5) comprised of a pair of substantially identical end caps 32 each releasably engaged with a respective end 20 and 21 of canister 14 such as via respective end pieces 16, 17 and a pole support 34 releasably engaged with canister 14. A telescopingly collapsible pole 36, shown extended in FIG. 2, is removably mounted to pole support 34 and which receives top bar 28 to hold banner 12 in the extended position, such as by fitting a mid-line hole 38 of top bar 28 over free end 39 of pole 36.

Figure 6:
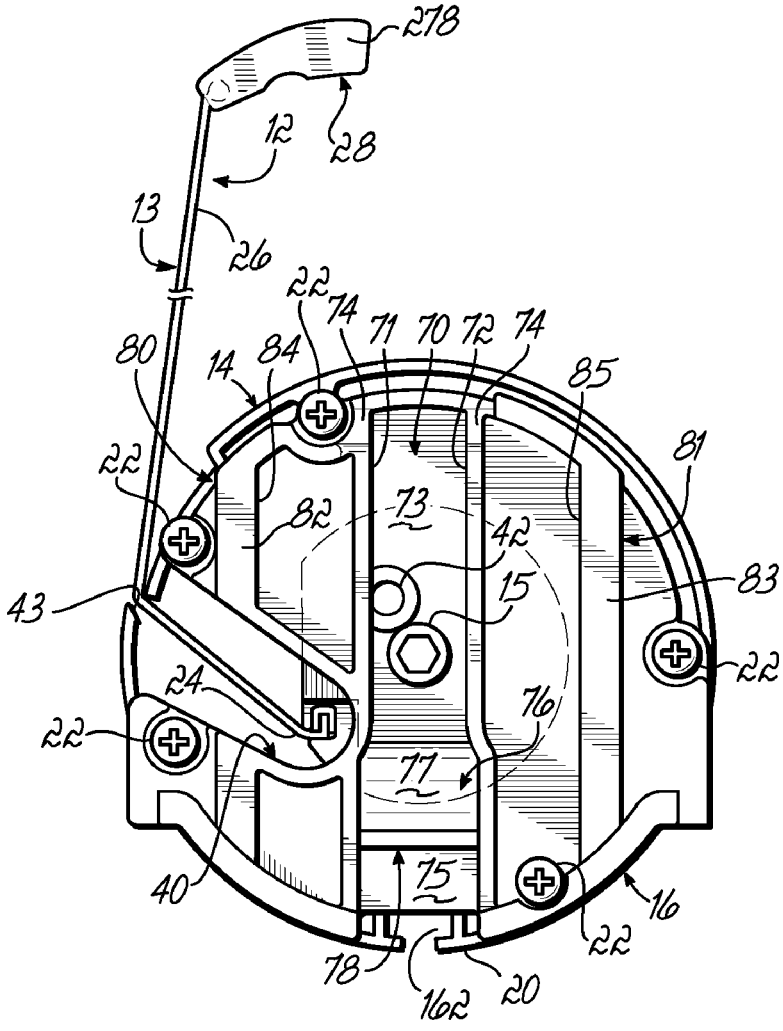
FIG. 6 is a plan, side view of an end piece attached to the canister of the retractable banner stand of FIG. 1 with the banner extended.

With further reference to FIG. 6, canister 14 is adapted to allow for change-out of the banner 12 similar to the conventional manner by provision of a radially extending slot 40 and pin-receiving hole 42 in at least end piece 16 (and/or 17). In that regard, as is done with conventional retractable banner stands, when end piece 16 is exposed, banner 12 is extended out through banner slot 43, which extends the length of canister 14 between opposite ends 20, 21, until the lower edge 24 of banner 12 is exposed and aligned with slot 40. A pin (such as core locking pin 44 shown in FIG. 7) is inserted into hole 42 to hold core 15 from retracting banner 12 into canister 14. The lower edge 24 may then be slid out of core 15 through slot 40. A replacement banner (not shown) may then be inserted through slot 40 and into core 15. Pin 44 is thereafter removed and the replacement banner retracted via banner slot 43 into canister 14. The top bar 28 is removed from banner 12 and fitted to the replacement banner before retracting the replacement banner, or the replacement banner could have its own top bar.

But such change-out of the banner, while available even with exemplary retractable banner stand 10 of the present invention, is not without drawbacks, especially in the field. The present invention overcomes those drawbacks by provision of the components above-mentioned and as will now be described in greater detail. In particular, one aspect of the present invention provides the end caps 32 which are releasably engaged to and disengaged from the ends 20, 21 of canister 14, such as via the end pieces 16, 17, all without tools. To that end, and with further reference to FIG. 7, each end cap 32 includes a central support element 50 having an inner aspect 52 which releasably engages canister 14, or at least a respective end piece 16 or 17 thereof, as will be explained in greater detail below. The outer aspect 54 of each end cap 32 provides the decorative aspects of a conventional end cap. Foldably mounted to the central support element is a pair of support legs 56, 58. Legs 56, 58 of each end cap 32 have an unfolded position (see, for example, FIGS. 1, 5 and 9) in which they extend from central support element 50 in opposite directions along a common plane 60 (FIG. 9) transverse to canister 14 when the end cap is mounted thereto to thus provide support for canister 14. Legs 56, 58 also have a folded or storage position (see, for example, FIGS. 8 and 10) so as to extend in parallel, but in spaced apart planes 62, 64 (FIG. 10), which are along opposite sides of canister 14 when the end cap 32 is mounted thereto. As seen in FIG. 8, when so folded, canister 14 and end caps 32 are compact and may be placed into a case or bag (not shown) for storage or transit.

With specific reference to FIGS. 4, 6, 9 and 11, each end piece 16, 17 (only the details of end piece 16 are shown) includes a channel 70 defined by walls 71, 72 projecting from face 73. Each wall 71, 72 may have a chamfered top edge 74 and may define a wide-mouth bottom section 75 of channel 70. Defined in channel 70 between walls 71, 72 is a bump-out 76 from face 73 which defines an upwardly directed camming surface 77 and generally horizontal lower lock face 78. Each end piece 16, 17 also includes a pair of slots 80, 81 outboard to either side of channel 70 and which can be defined by laterally extending ledges 82, 83, respectively, extending either from walls 71, 72 or from further walls 84, 85 projecting from face 73 generally parallel to walls 71, 72.

With specific reference to FIGS. 7, 9, and 11-14, the inner aspect 52 of each end cap 32 (only one shown) includes a channel 90 defined by walls 91, 92 extending from inner face 93, with each wall 91, 92 including a notch slot 94. A resilient plastic retainer clip 96 has a generally vertical web 98 terminating at upper end 100 in an enlarged-width head area 101 and a C-shaped pin-receiving spring-slot 102 and at lower end 103 in a pair of outer lock cams 104, each having a downwardly directed camming surface 105 and a generally horizontal upper lock face 106. Extending generally horizontally from the backside 108 of web 98 is a pivot ledge 109 sized to be frictionally engaged within notch slots 94 to secure clip 96 to the inner aspect 52 and about which clip 96 flexes as will be described below. A core locking pin 44 may be removably received in slot 102 for storage. Also associated with inner aspect 52 is a pair of ledges 110, 112 outboard of channel 90 and supported on walls 113, 114 extending from face 93 generally parallel to walls 91, 92 such that ledges 110, 112 are generally parallel to face 93. A coil spring 116 is situated in channel 90 to extend between face 93 of central support element 50 and lower end 103 of clip 96.

Figure 15:
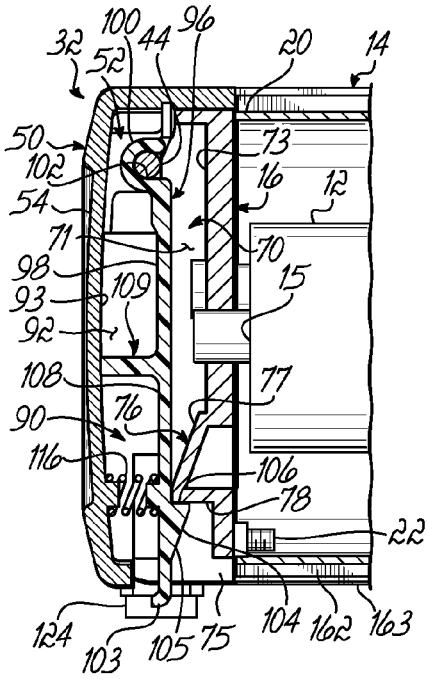
FIG. 15 is a cross section view taken along lines 15-15 of FIG. 3.

Clip 96 and ledges 110, 112 of end caps 32 are sized and positioned so as to align with channel 70 and slots 80, 81, respectively, of respective end pieces 16, 17 to facilitate releasable engagement of end caps 32 with canister 14. An end cap 32 is situated above canister 14 with the ledges 110, 112 in registry with the slots 80, 81 of an end piece 16 or 17, and end cap 32 and canister 14 are moved relative to one another to cause ledges 110, 112 to slide into slots 80, 81 such as along arrow 118 in FIG. 11. As that movement continues, the camming surfaces 105 of lock cams 104 bear against camming surface 77 of bump-out 76 causing lower end 103 of clip 96 to flex about pivot ledge 109, until lock faces 106 pass to just below bump-out 76 such that the resiliency of clip 96 (and/or spring 116 if present) causes cam locks 104 to snap under bump-out 76 to bring lock faces 105 and 78 into confronting relationship. Also, walls 71, 72 project outwardly of face 73 sufficiently that the enlarged-width head area 101 of clip 96 bears against and rides over chamfers 74 to rest against walls 71, 72 under bending tension. With ledges 110, 112 in slots 80, 81 and the clip 96 engaged with bump-out 76 as seen in FIG. 15, the end cap 32 is releasably engaged to canister 14. The bending tension on clip 92 helps urge end cap 32 apart from end piece 16 or 17 thus taking up play between ledges 110, 112 and slots 80, 81 providing a more sure fit and avoiding or reducing the tendency for the parts to rattle or feel loose. Additionally, walls 91, 92 of end cap 32 and walls 71, 72 of the end piece 16 or 17 or positioned so as to be in confronting relationship when the end cap 32 is releasable engaged to canister 14. As a result, impact forces on end cap 32 are transmitted to the respective end piece 16 or 17 to help minimize denting or deformation of center support 50.

Figure 16:
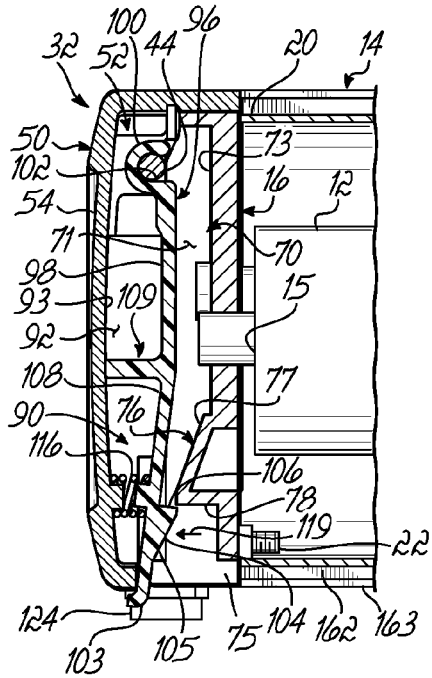
FIG. 16 is a view like FIG. 15 showing actuation of a retainer clip to facilitate removal of an end cap.

Removal of end cap(s) 32 from canister 14 is accomplished by inserting a finger or thumb (not shown) into mouth 75 of channel 70 behind lower end 103 of clip 96 and compressing clip 96 toward face 93 so as to flex clip 96 and bring lock cams 104 out from under bump-out 76 as indicated by arrow 119 in FIG. 16. End cap 32 may be pulled off from canister 14 by creating relative movement between end cap 32 or 33 and canister 14 in the direction opposite to that used to mount them together (e.g., in the direction opposite of arrow 118 in FIG. 11) to thus slide ledges 110, 112 out of slots 80, 81 until the end cap 32 is free of canister 14.

Figure 7:
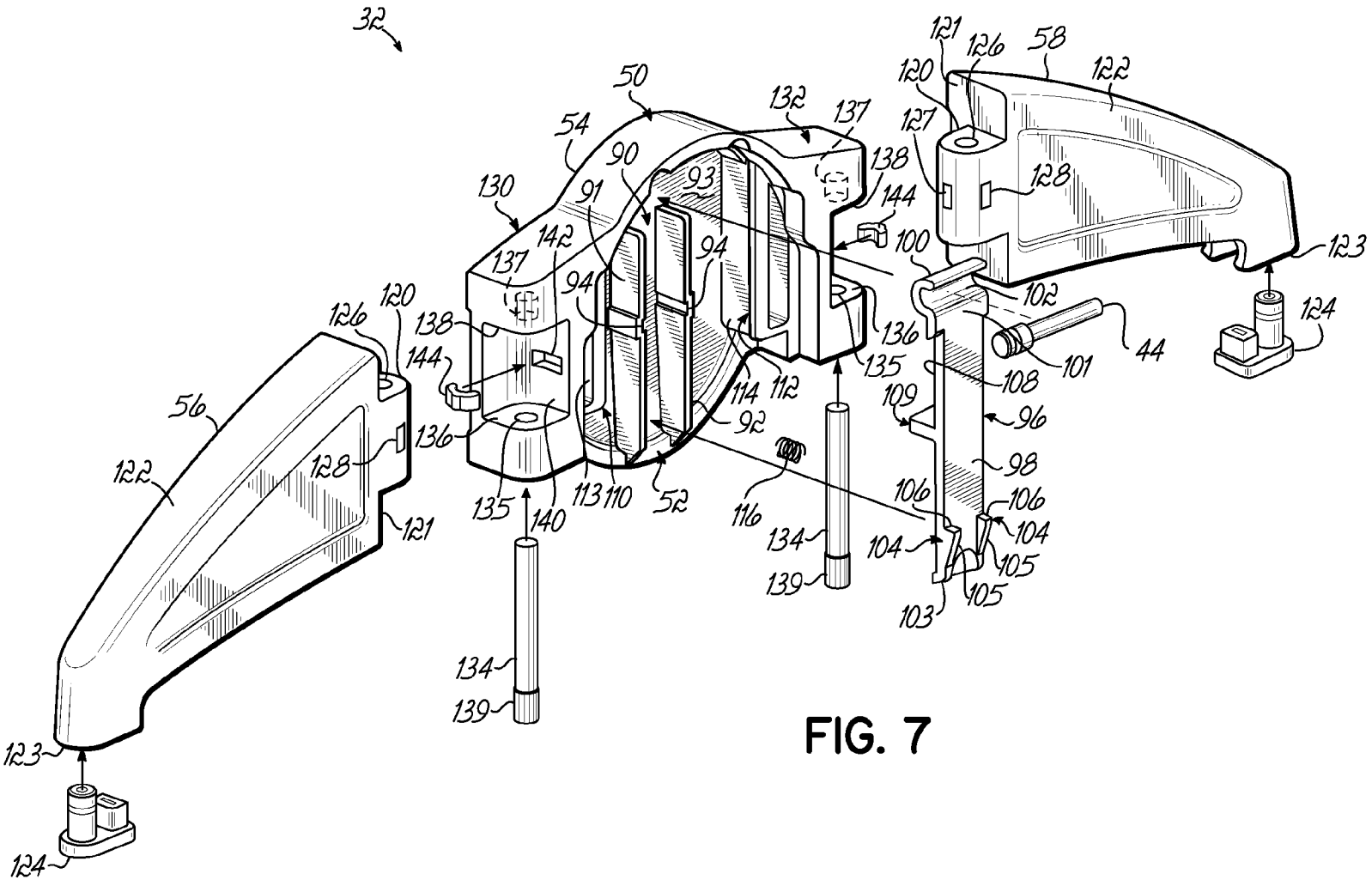
FIG. 7 is an exploded, perspective view of an end cap of the kit of FIG. 5.
Figure 8:
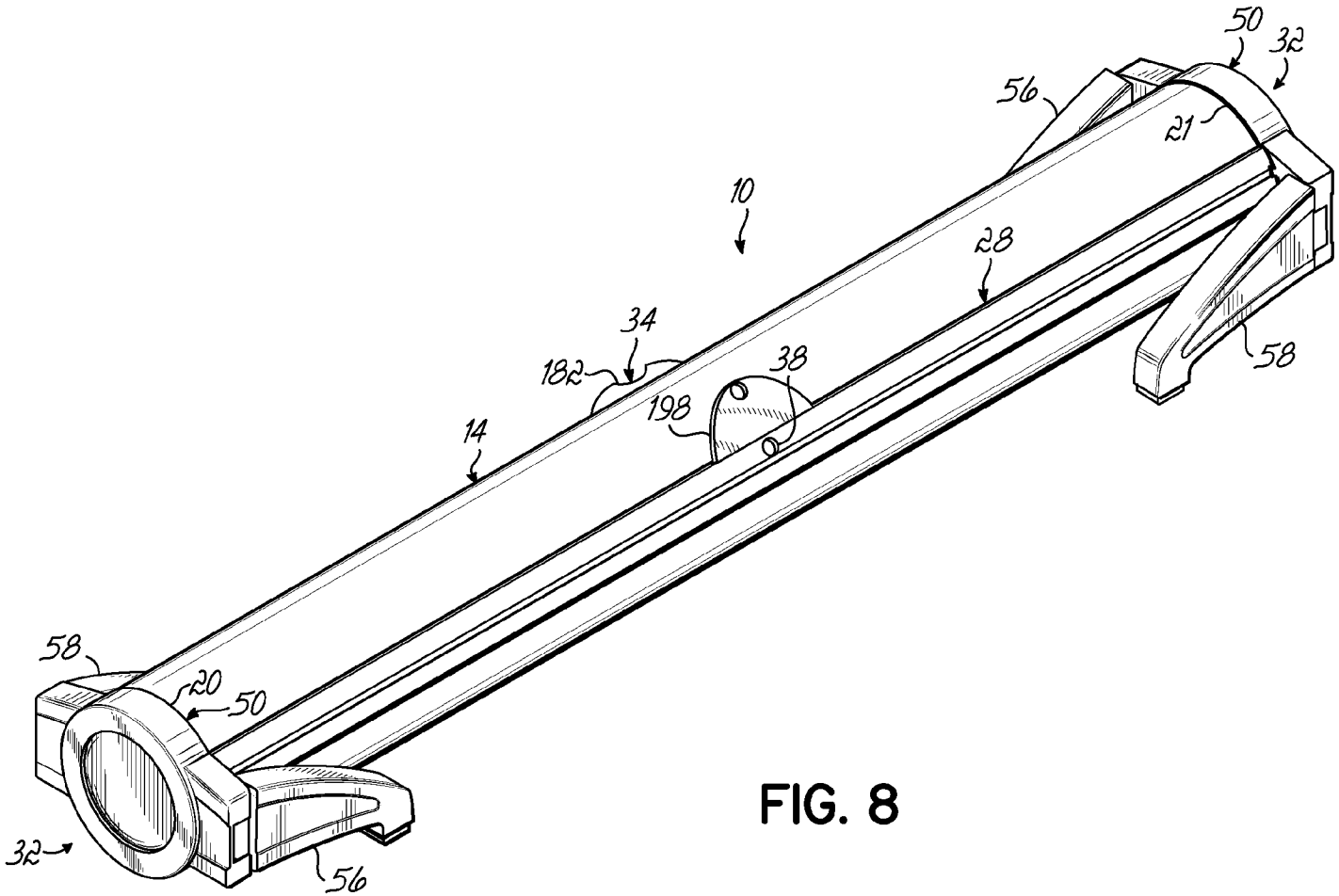
FIG. 8 is a perspective view similar to FIG. 3 with the end cap legs in the folded position in accordance with certain principles of the present invention.
Figure 9:
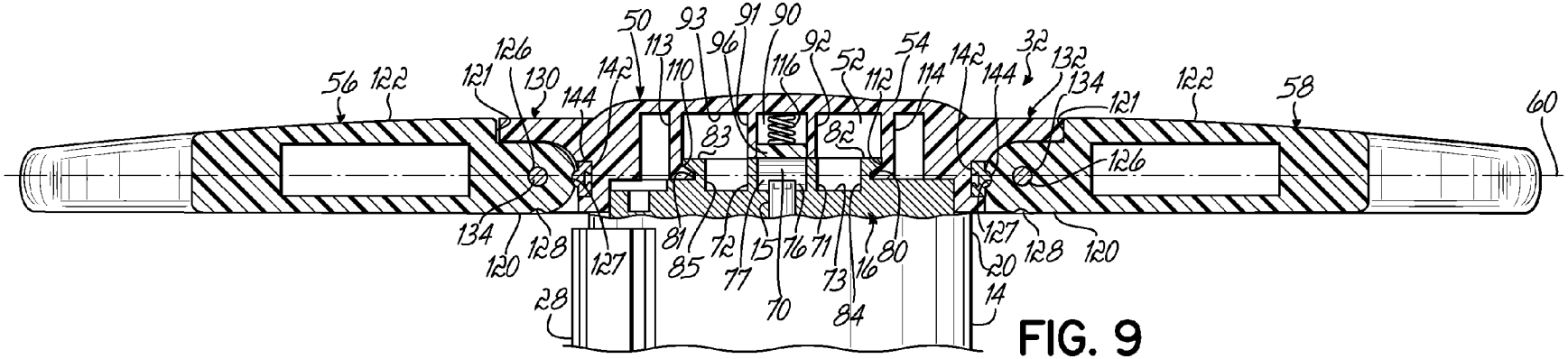
FIG. 9 is a top, partial cross section view of an end of the retractable banner stand of FIG. 1 with the legs of the end cap in the unfolded position in accordance with certain principles of the present invention.
Figure 10:
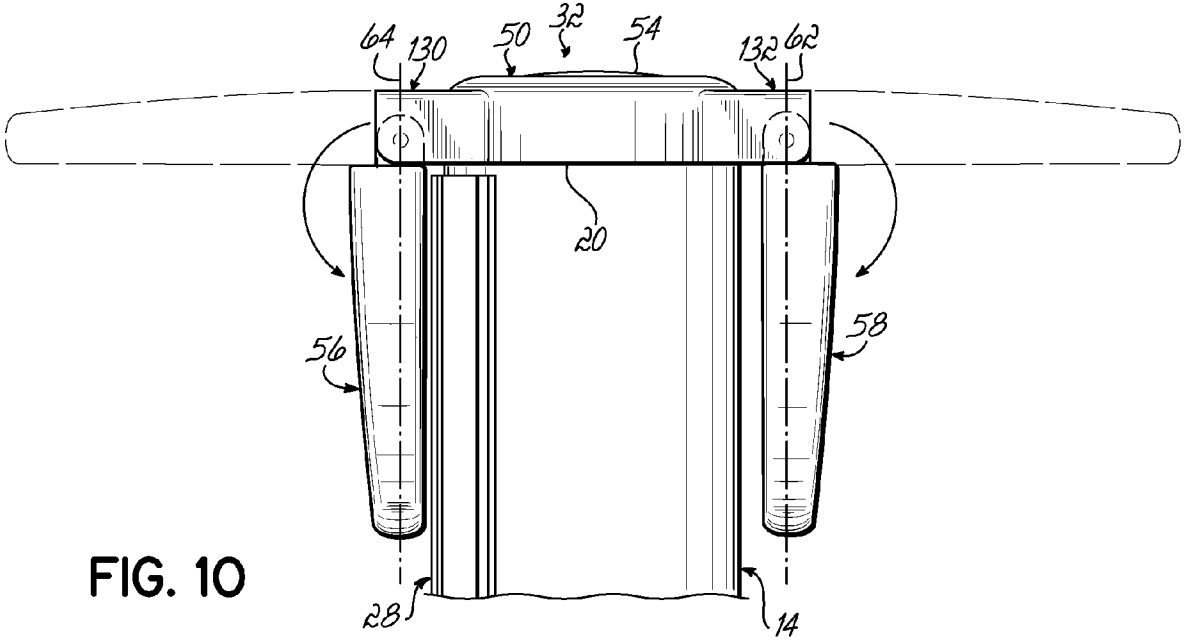
FIG. 10 is a top, partial view of an end of the retractable banner stand of FIG. 1 with the legs of the end cap in the folded position in accordance with certain principles of the present invention.
Figure 11:
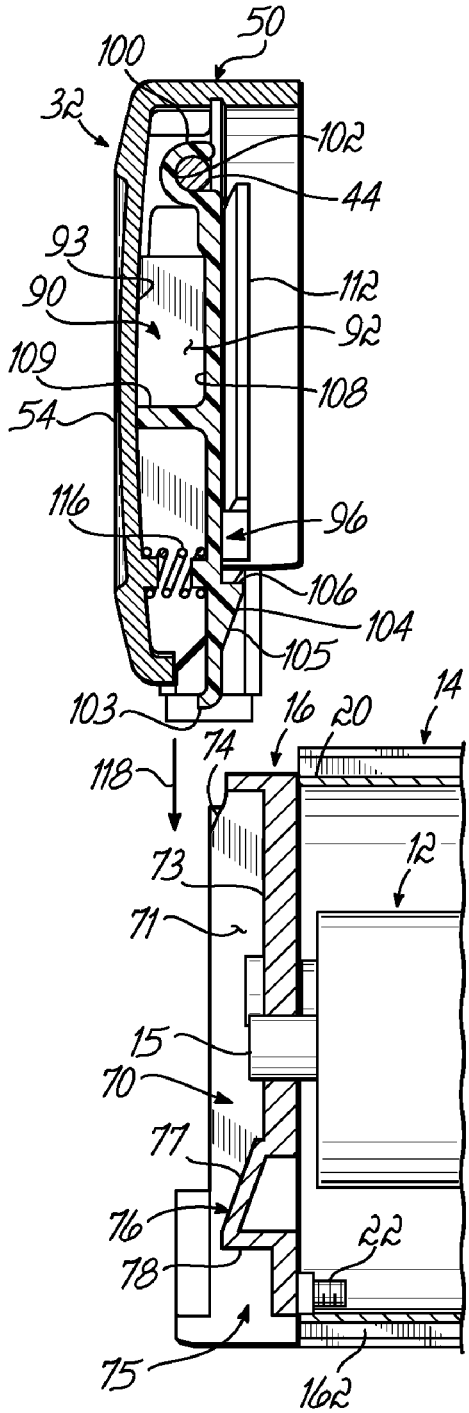
FIG. 11 is a partial, cross-sectional, exploded side view of an end cap being mounted to the canister of the retractable banner stand of FIG. 1 in accordance with certain principles of the present invention.
Figure 12:
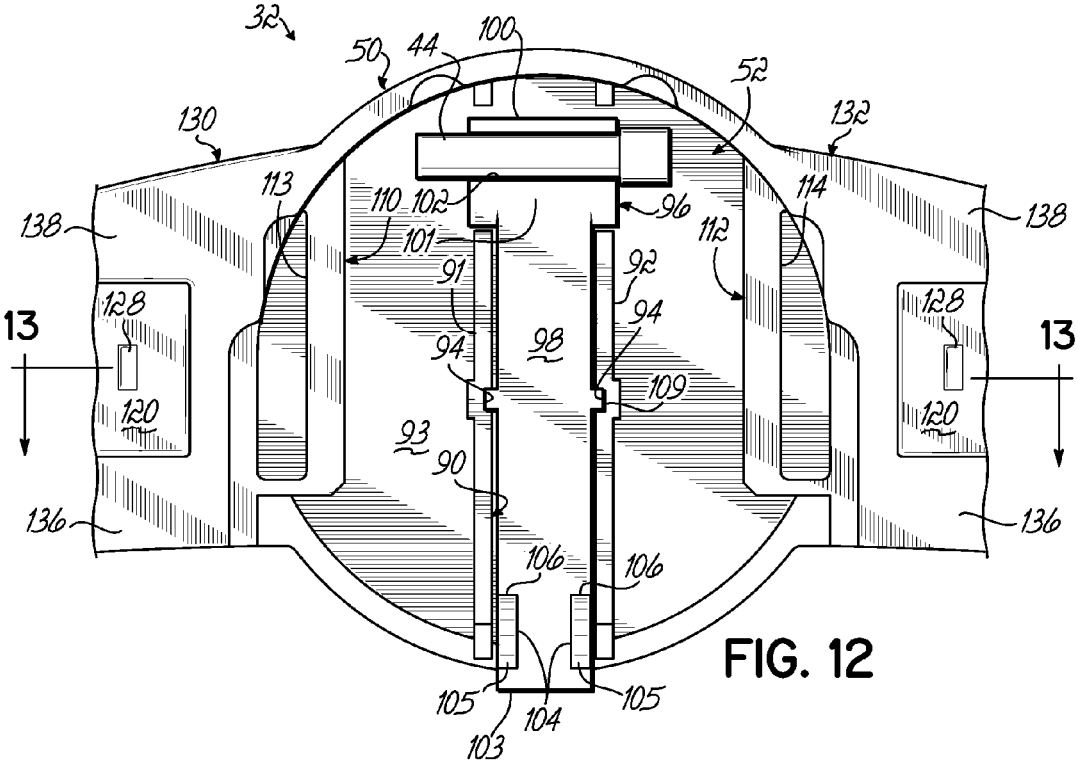
FIG. 12 is a partial, inside plan view of an end cap of FIG. 5 with the legs in the unfolded position.
Figure 13:
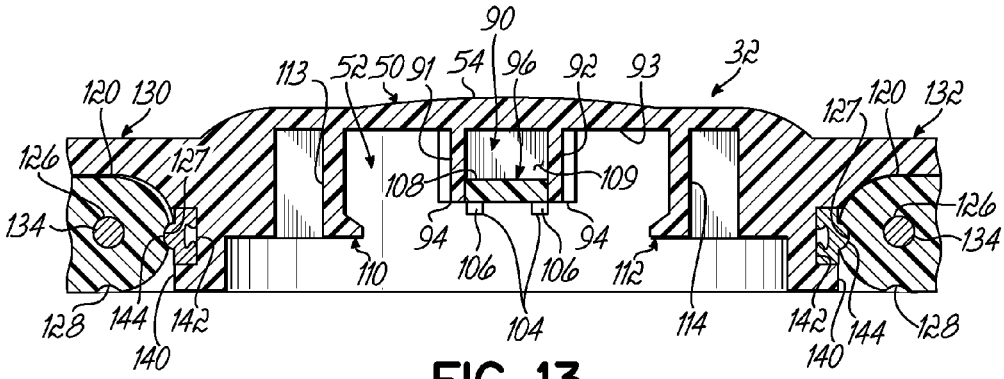
FIG. 13 is a cross section view taken along lines 13-13 of FIG. 12.

As seen more particularly in FIGS. 7 and 9, each leg 56, 58 includes a central tongue 120 at its terminal end 121, and a mid-section 122 extending from terminal end 121 to a foot 123. A foot pad 124 is mounted to foot 123 for resting on a surface (not shown). The tongue 120 includes a vertical axle-hole 126, and has a pair of vertically-oriented detent recesses 127, 128 offset by 90° for helping to hold legs 56, 58 in the respective unfolded and folded positions as will be explained. Similarly, the central support element 50 of each end cap 32 or 33 includes a pair of oppositely disposed side edges 130, 132 outboard thereof and defining tongue-mounting yokes to receive the respective tongues 120 of each leg 56, 58. An axle 134 is inserted through a hole 135 in the bottom wall 136 of each yoke 130 or 132 and the axle-hole 126 of the respective tongue 120 received in the yoke 130 or 132. The axle 134 advantageously extends completely through axle-hole 126 and into an aperture 137 (shown in dotted line in FIG. 7) in the top wall 138 of the yoke 130 or 132. The bottom end 139 of the axle(s) 134 may be splined to help frictionally engage into hole(s) 135. The axles 134 in association with yokes 130, 132 define plane 60.

Formed in the back wall 140 of each yoke 130, 132 is a slot 142 (only one seen if FIG. 7) into which is secured a resilient, plastic or rubber-like detent member 144 sized and positioned to flex into and out of the recesses 127, 128 of the leg 56 or 58 mounted thereto. Thus, with the legs 56, 58 in the unfolded position, the detent members 144 extend into respective recesses 127 to help hold legs 56, 58 in that unfolded position, while in the folded position, the detent members 144 flex into recesses 128 to help hold legs 56, 58 in that folded position. As each leg 56, 58 is moved between the folded and/or unfolded positions, the associated detent member 144 flexes out of the associated recesses 127, 128 until the folded or unfolded position is reached. As will be appreciated, a manually releasable, spring loaded plunger or similar protrusion (not shown) may additionally or alternatively be provided to releasably lock legs 56, 58 in the folded and/or unfolded positions.

Figure 14:
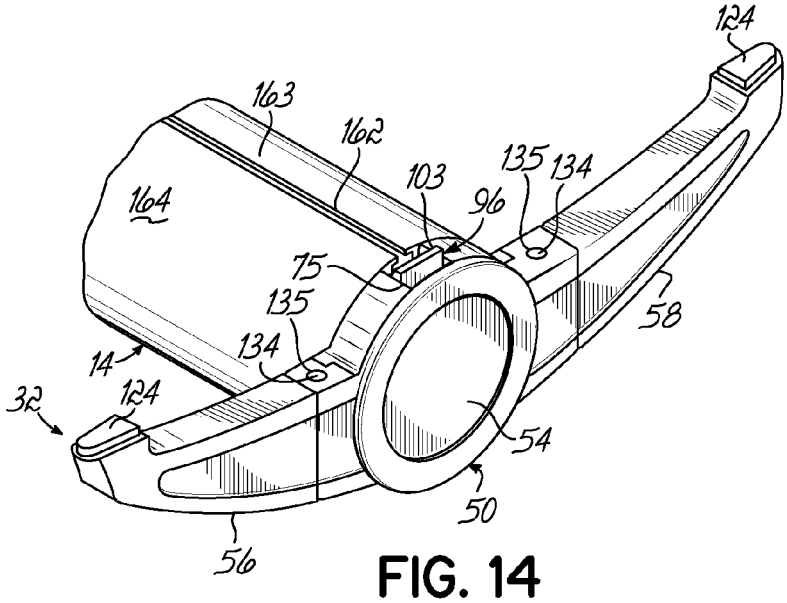
FIG. 14 is a bottom, perspective view of an end of the retractable banner stand of FIG. 1.
Figure 17:
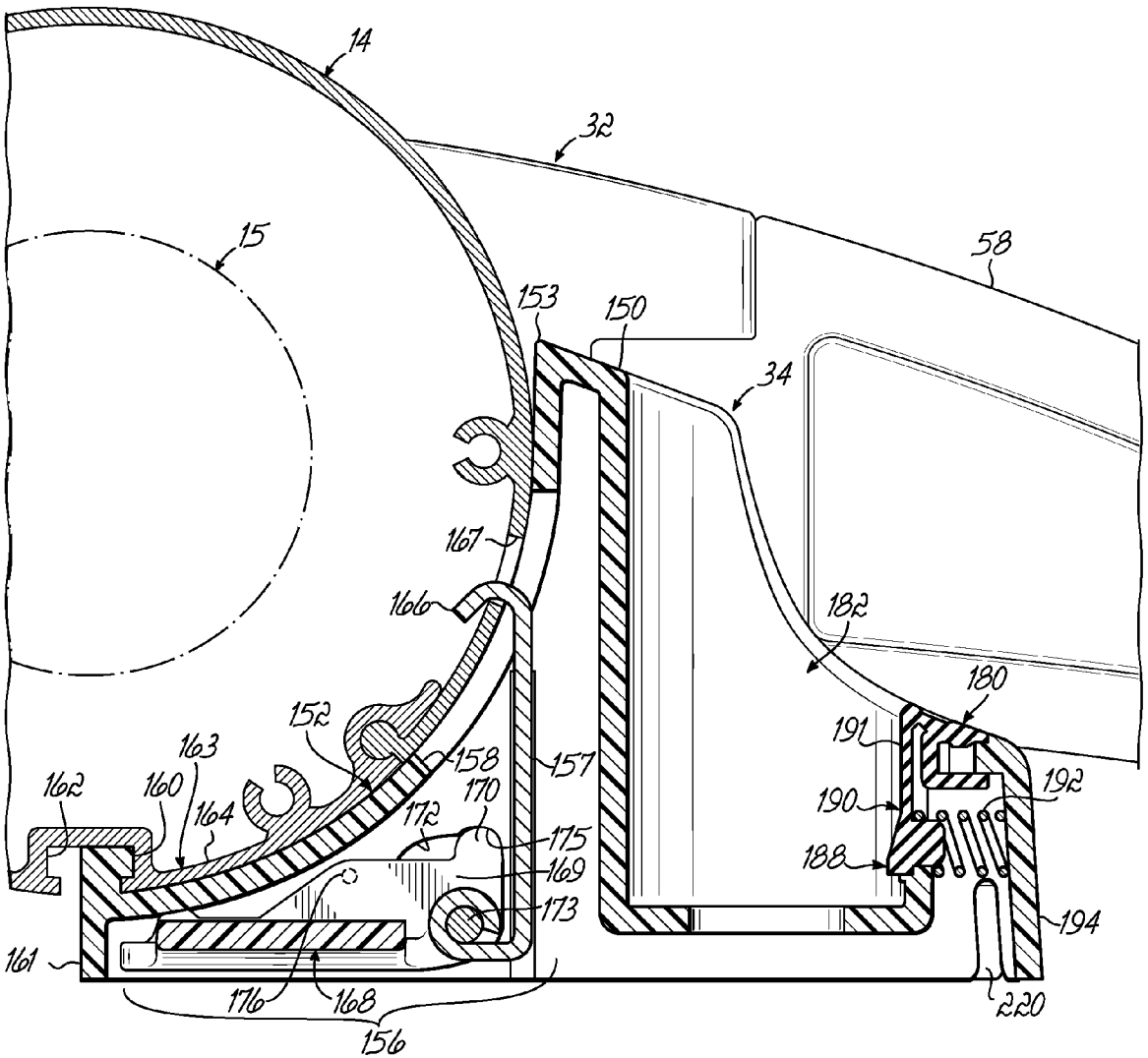
FIG. 17 is a partial, cross-section view taken along lines 17-17 of FIG. 3.
Figure 18:
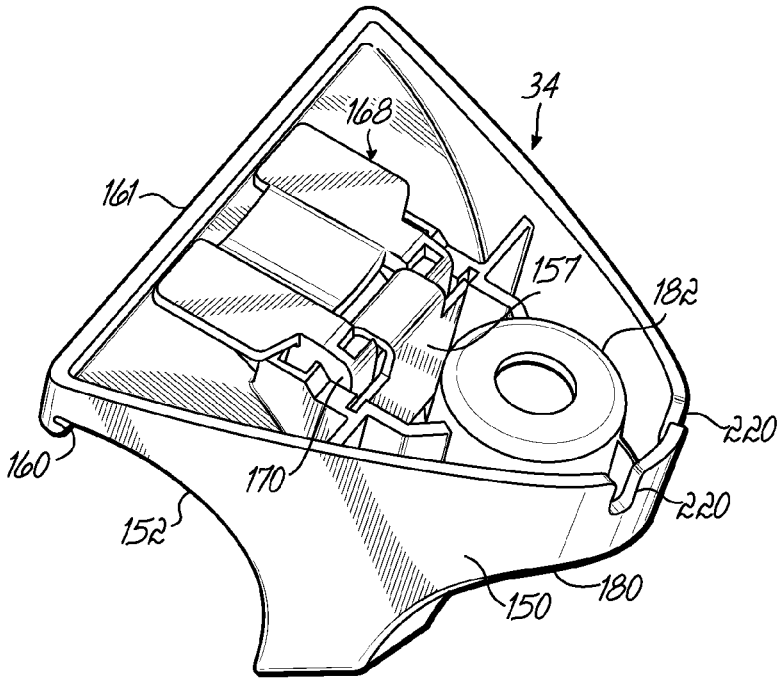
FIG. 18 is a bottom perspective view of the pole support of FIG. 5 in the locked position.
Figure 19:
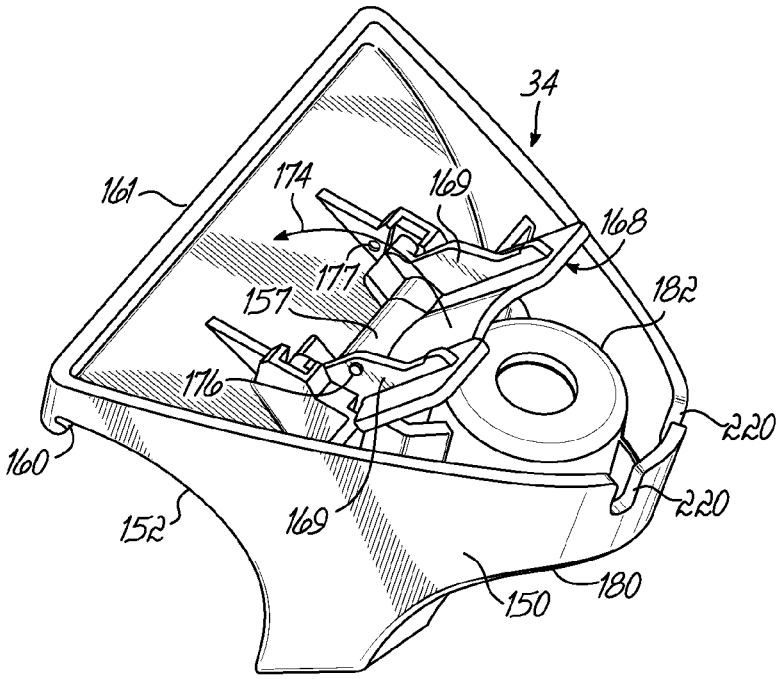
FIG. 19 is a view similar to FIG. 18 but showing the pole support in the unlocked position.
Figure 20:
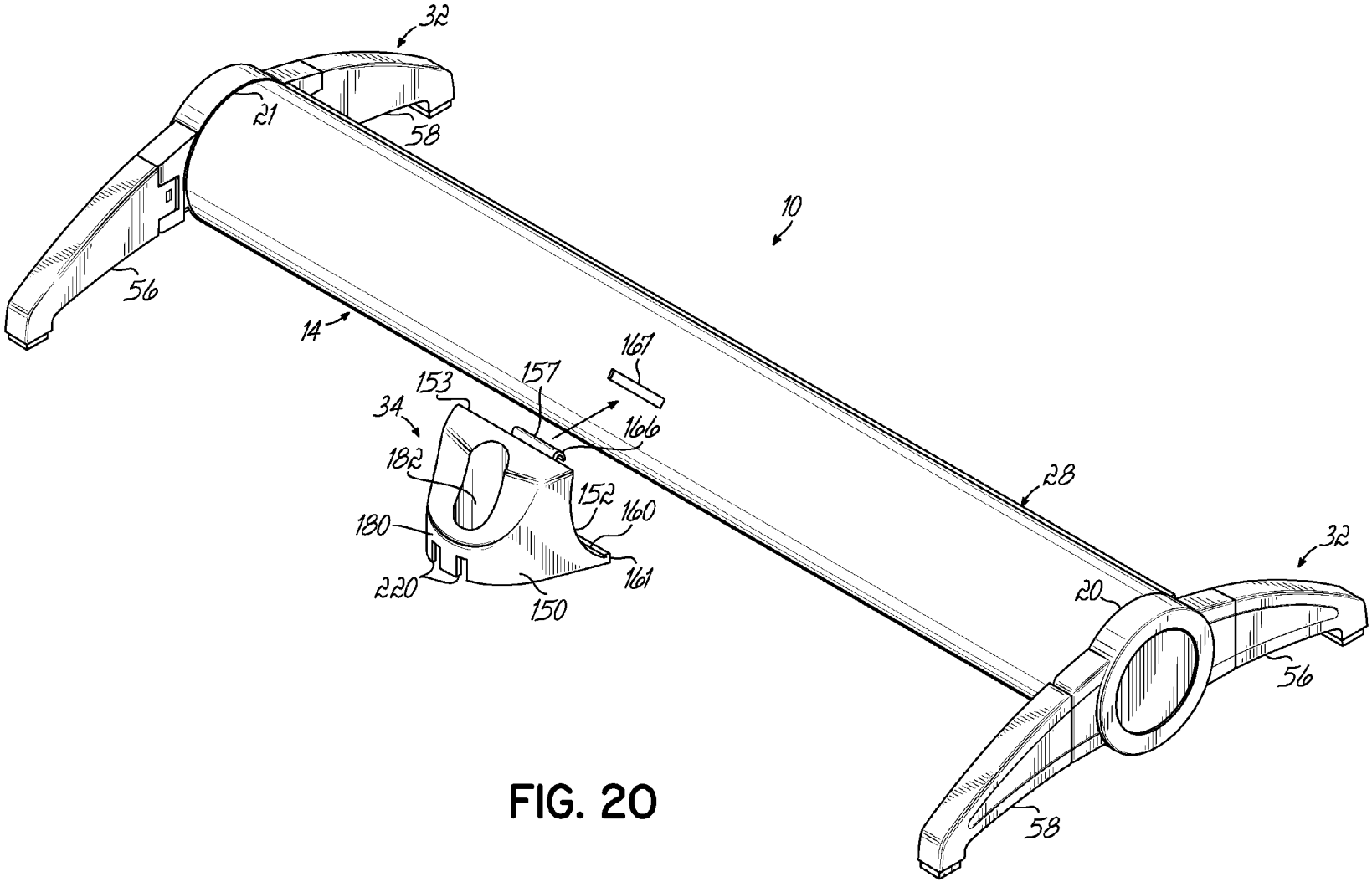
FIG. 20 is a view similar to FIG. 2 but with the banner retracted, the pole removed, and the pole support disengaged from the canister for purposes of explaining further principles of the present invention.

Pole support 34 may also be releasably engaged with canister 14. To that end, and with specific reference to FIGS. 17-20, pole support 34 has a housing member or base 150, which may be plastic, defining a cradle 152 at one end 153 shaped to selectively receive and seat thereon the canister 14 as seen in FIG. 17. Pole support 34 also includes a gripping structure 156 to releasably engage to and disengage from canister 14, all without tools. To that end, gripping structure 156 includes a retractable hook 157 moveable within housing member 150 so as to extend toward and away from cradle 152 through opening 158 along cradle 152 and a tab 160 at the forward end 161 of cradle 152. Tab 160 is adapted to be received into a longitudinal groove 162 extending along the bottom 163 of wall 164 of canister 14 (FIG. 14). Hook 157 has a curved end 166 adapted to releasably engage a hook receiver or slot 167 formed into or through a central aspect of wall 164 spaced above groove 162 (FIG. 20).

Rotatably mounted within housing member 150 below cradle 152 is a lever 168 having a pair of underside support walls 169 each terminating in a hook end 170 rotatable within slot 172 of housing 150 (FIG. 17) so as to move axle end 173 toward and away from cradle 152 depending on the position of lever 168. Hook 157 is pivotally mounted for movement with axle end 173 such that in a first or unlocked position of lever 168 shown in FIG. 19, hook 157 has been moved upwardly through opening 158 (see FIG. 20) so as to cause end 166 to come loose from hook receiver 167, and in a second or locked position of lever 168 shown in FIGS. 17 and 18 (achieved by rotating lever 168 in the direction of arrow 174 in FIG. 19), hook 157 is pulled downwardly relative to opening 158 so as to pull end 166 tight into hook receiver 167 such that with canister 14 received against cradle 152 and tab 160 in groove 162, pole support 34 is releasably engaged with canister 14. Slot 172 may advantageously include a slight depression 175 to more firmly engage with hook end 170 as axle end 173 is moved over-center into the locked position. Also, one or both of support walls 169 may include a detent 176 to engage into a detent recess 177 (FIG. 19) in the locked position. The engagement of hook end 170 with depression 175 and/or the engagement of detent 176 with detent recess 177 helps hold lever 168 in the locked position.

At the other end 180 of pole support 34 is a pole-receiver 182 sized and shaped to receive an end 184 of pole 36 therein (FIG. 2). Pole 36 may be provided with a longitudinal groove 186, at least adjacent end 184 (FIG. 2). Extending into pole-receiver 182 is a spring-biased projection 188 adapted to mate into groove 186 when pole 36 is mounted therein to help orient pole 36. Projection 188 may be defined on the end 190 of a resilient member 191 secured to pole support 34, and confronting a coil spring 192 mounted between end 190 and back wall 194 of housing member 150 as seen in FIG. 17. Projection 188 could alternatively be formed as a rigid portion of pole support 34.

Figure 22:
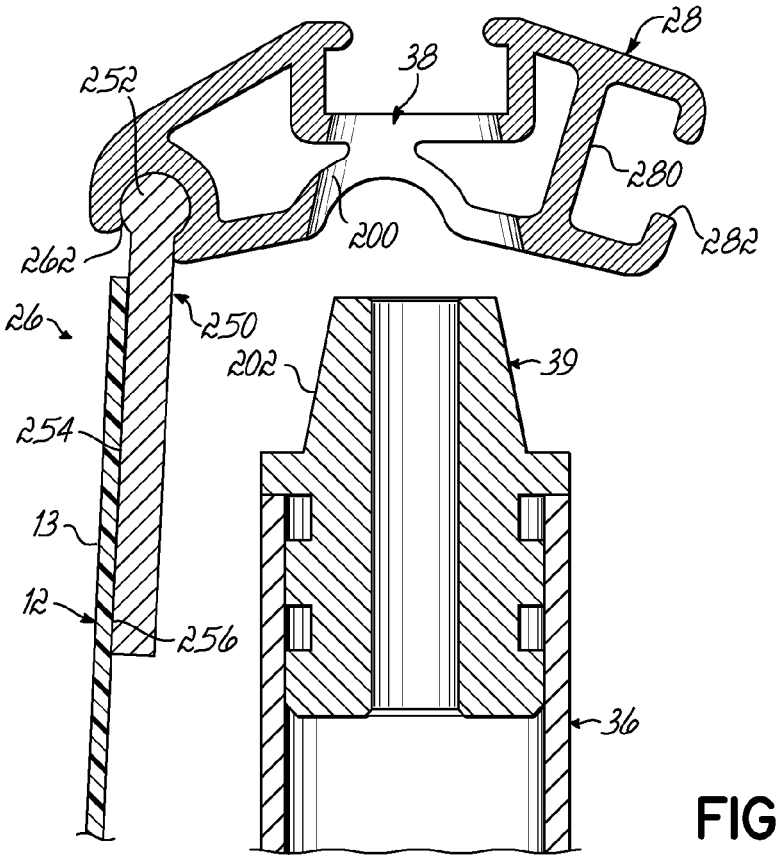
FIG. 22 is an exploded, partial cross-sectional view of the top bar and the top of the pole of the retractable banner stand of FIG. 1 with the top bar separated from the pole.
Figure 23:
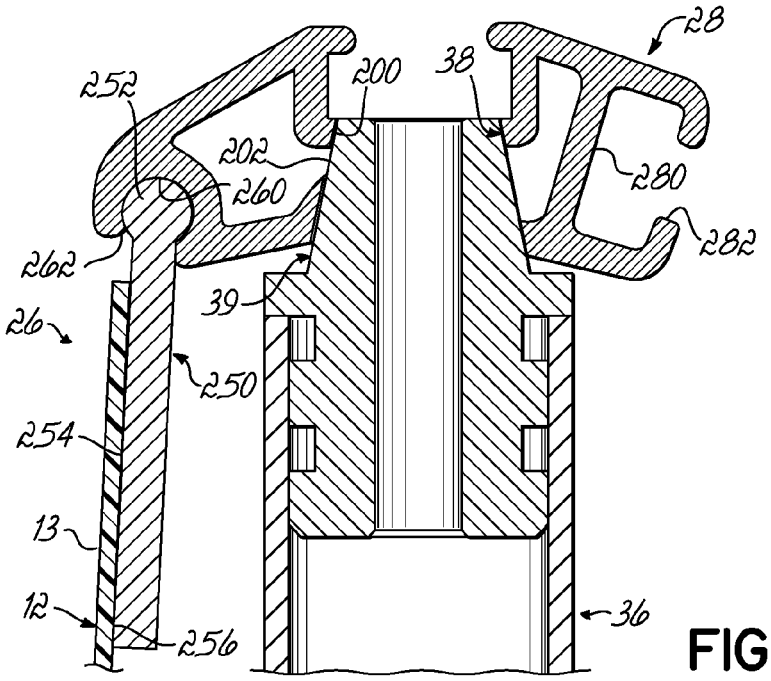
FIG. 23 is a view like FIG. 22 but with the top bar mounted to the pole.

In use, end caps 32 and pole support 34 of kit 30 are attached to canister 14, and legs 56, 58 are placed into the unfolded position. Pole 36 is extended and locked in that position by vertical lock clamps 196 (such as may be found on some metal, telescoping canes or tripods) and end 184 is inserted into pole support 34 (FIG. 2). Top bar 28, or a flexible handle 198 attached thereto, is gripped by the user (not shown) and pulled to extend banner 12 out from canister 14 until top bar 28 is proximate free end 39 of pole 36 at which time top bar 28 is mounted thereto to hold banner 12 in the extended position. To that end, and with reference to FIGS. 22 and 23, hole 38 of top bar 28 and pole end 39 are advantageously mutually tapered like the frustrum of a cone as at 200 and 202, respectively, to facilitate reliable mounting of top bar 28 to pole 36 with banner 12 extended. After use, top bar 28 is lifted off of pole 36 (until pole end 39 is free of hole 38) and banner 12 allowed to retract into canister 14. Legs 56, 58 may be moved into the folded position for storage or transit. Pole 36 is removed from pole support 34 and collapsed for storage or transit. Pole support 34 may be removed from canister 14 if desired, or may be kept thereon for storage or transit.

Figure 21:
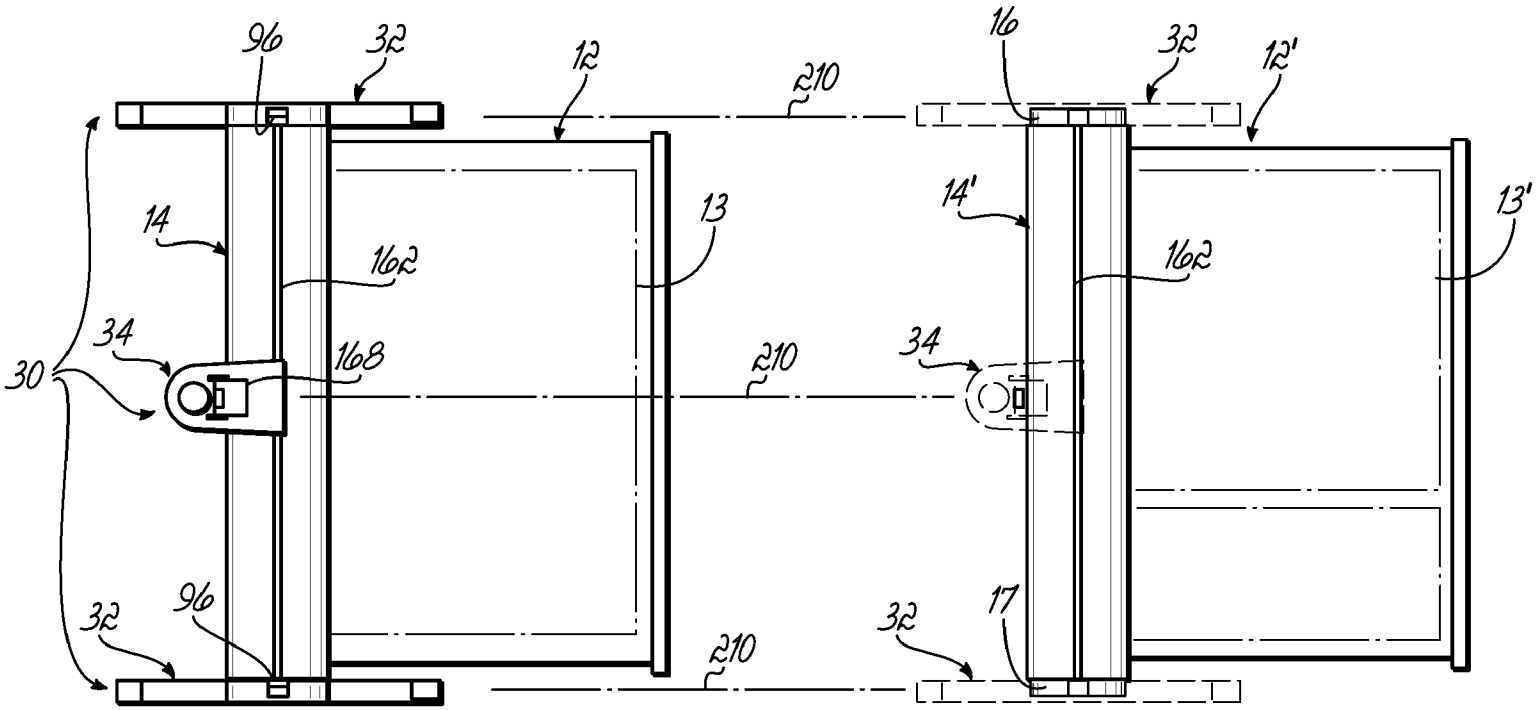
FIG. 21 is a schematic representation, from the bottom but with the banners extended away from the pole support side of the canister, for purposes of illustration a method of changing banners in accordance with the principles of the present invention.

With reference to FIG. 21, in order to change banners, instead of having to access banner 12 within canister 14 to replace same, a new banner 12' having a different viewable ad and/or message 13' from banner 12 may be put into use by the mere expedient of removing kit 30 from first canister 14, and reattaching kit 30 to a second canister 14' containing the different banner 12'. To that end, each end cap 32 may be removed from canister 14 by separately grasping the end cap to flex the associated clip 96 and sliding the end cap off from the first canister 14. Pole support 34 may also be removed from canister 14 by moving lever 168 to the unlocked position to loosen end 166 from receiver 167 such that cradle tab 160 may be removed from groove 162. Changing banners is then accomplished by performing the reverse processes to attach kit 30 to the second canister 14' as exemplified by dot-dashed lines 210 in FIG. 21, by sliding end caps 32 onto end pieces 16, 17, respectively, of the second canister 14' until the clips 96 thereof lock to the second canister 14' to thereby releasably engage end caps 32 to the second canister 14'; and, before, during or after that, second canister 14' is set into cradle 152 of pole support 34 with tab 160 in groove 162 thereof and lever 168 is moved to the locked position such that hook end 166 grips receiver 167 to thereby releasably engage pole support 34 to the second canister 14'. Pole 36 is mounted to pole support 34 and banner 12' is extended from canister 14' to display the different message and/or ad 13'. It will be appreciated that banners 12, 12' would normally be extended into the page in normal use, but are shown extended to the right for illustrative purposes.

Figure 24:
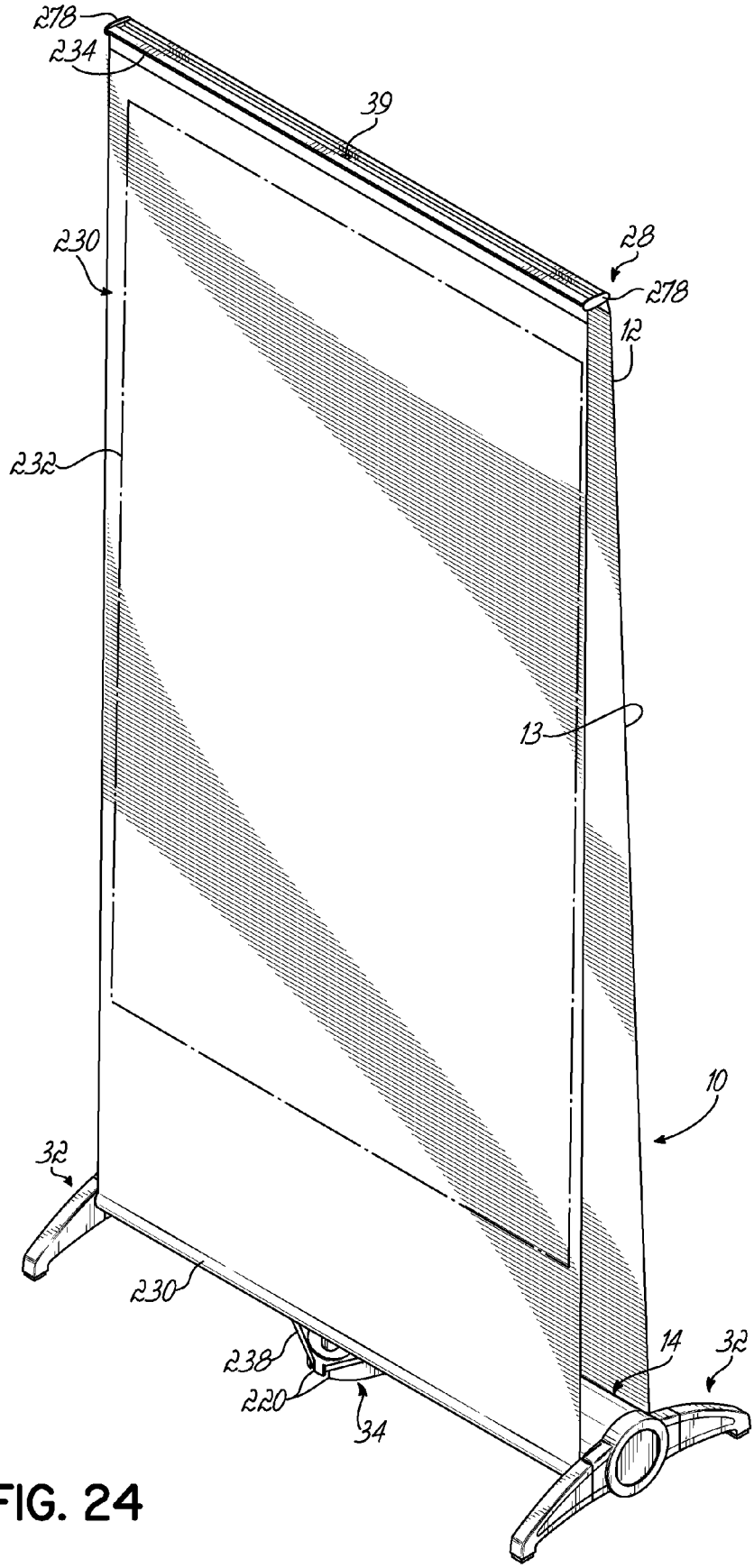
FIG. 24 is a rear perspective view of the retractable banner stand of FIG. 1 with a roll-up banner mounted thereto in accordance with a yet further feature of the present invention.

In accordance with a yet further aspect of the present invention, it is possible to simultaneously display two banners with banner stand 10. To that end, pole support 34 includes at least one, but advantageously may include two, banner tensioning receptacles 220 formed in back wall 194 thereof which define vertical slots in member 150. A roll-up banner 230 with its own viewable ad or message 232 may be unrolled and the top end 234 thereof mounted to top bar 28 along with that of banner 12 as will be described below, and the bottom end 236 of second banner 230 may be held to pole support 34 such as by stringing the tension cord 238 associated with bottom end 236 though the receptacle(s) 220 as seen in FIG. 24. In that position, the roll-up banner 230 is also in a display position along with banner 12, such that the banner stand 10 of the present invention allows for display of two banners in the same space as the banner stand 10, without the additional cost or manipulation of further structure normally associated with roll-up banners such as second banner 230.

As will be appreciated, banner 12 may be mounted to top bar 28 in any desirable manner known in the art. In the banner stand 10 shown herein, and with reference to FIGS. 22 and 23, a mounting member 250 having a rod-shaped upper aspect 252 and a flat face 254 depending therefrom is used to facilitate mounting end 26 of banner 12 to top bar 28. More particularly, the back side 256 of end 26 is securely adhered to flat face 254. Top bar 28 includes a circular cross-section cylinder 260 extending along its length. The cylinder 260 includes a downwardly and outwardly opening lower slot 262 running therealong. The upper aspect 252 of mounting member 250 is inserted through an open end 270 (See FIGS. 25 and 26) of top bar 28 into the cylinder 260 with the flat face 254 extending out through slit 262 to expose ad or message 13. End caps 278 (not shown in FIGS. 22 and 23) may be attached at each end 270 of top bar 28 to conceal the opening(s) into cylinder 260 and/or other aspects of top bar 28. Other cross-sectional shapes for upper aspect 252 and cylinder 260 could be used if desired but advantageously, they should be of matching cross-section.

Figure 25:
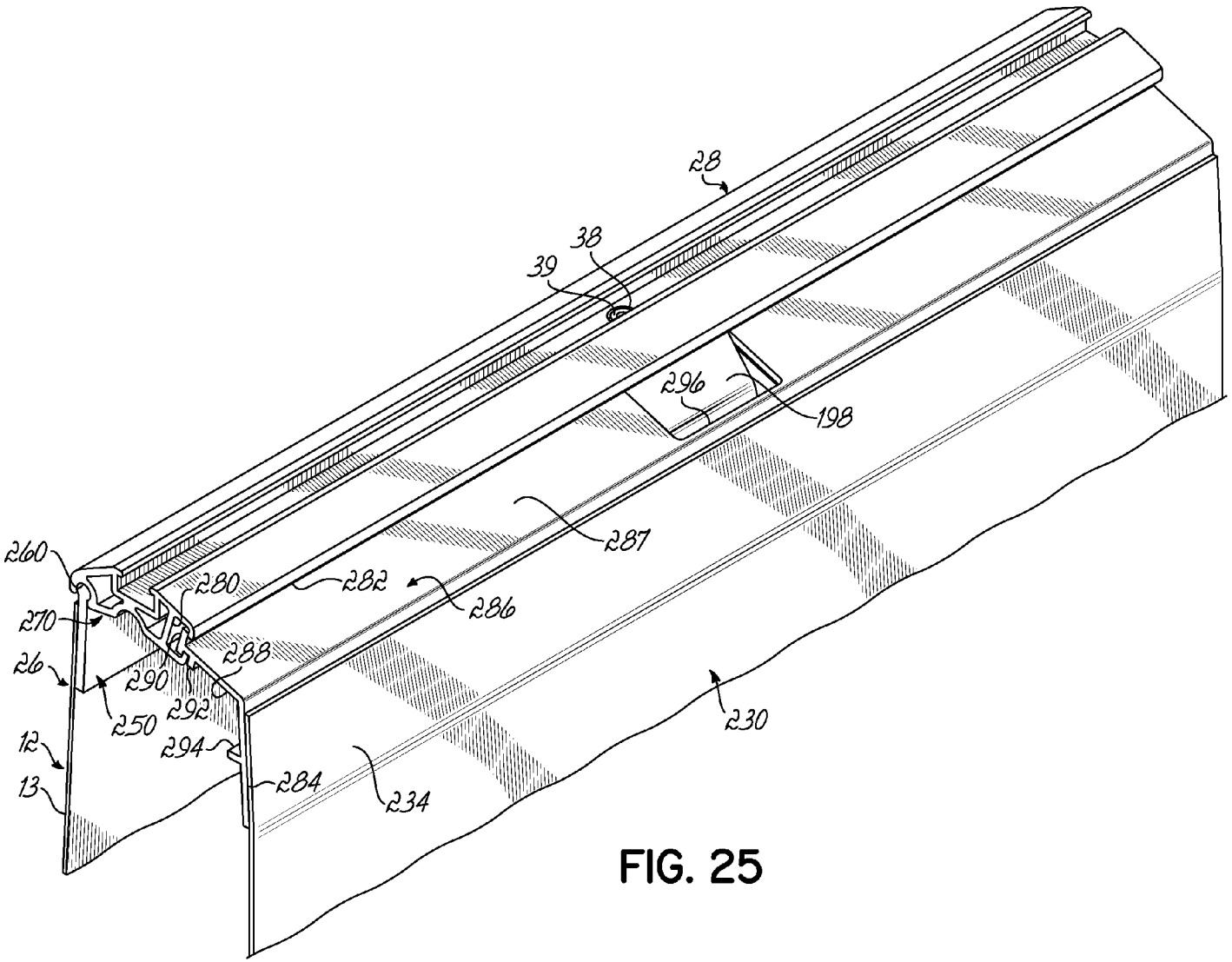
FIG. 25 is a partial, perspective view of the top of the retractable banner stand and roll up banner of FIG. 24 for purposes of explaining further principles of the present invention.
Figure 26:
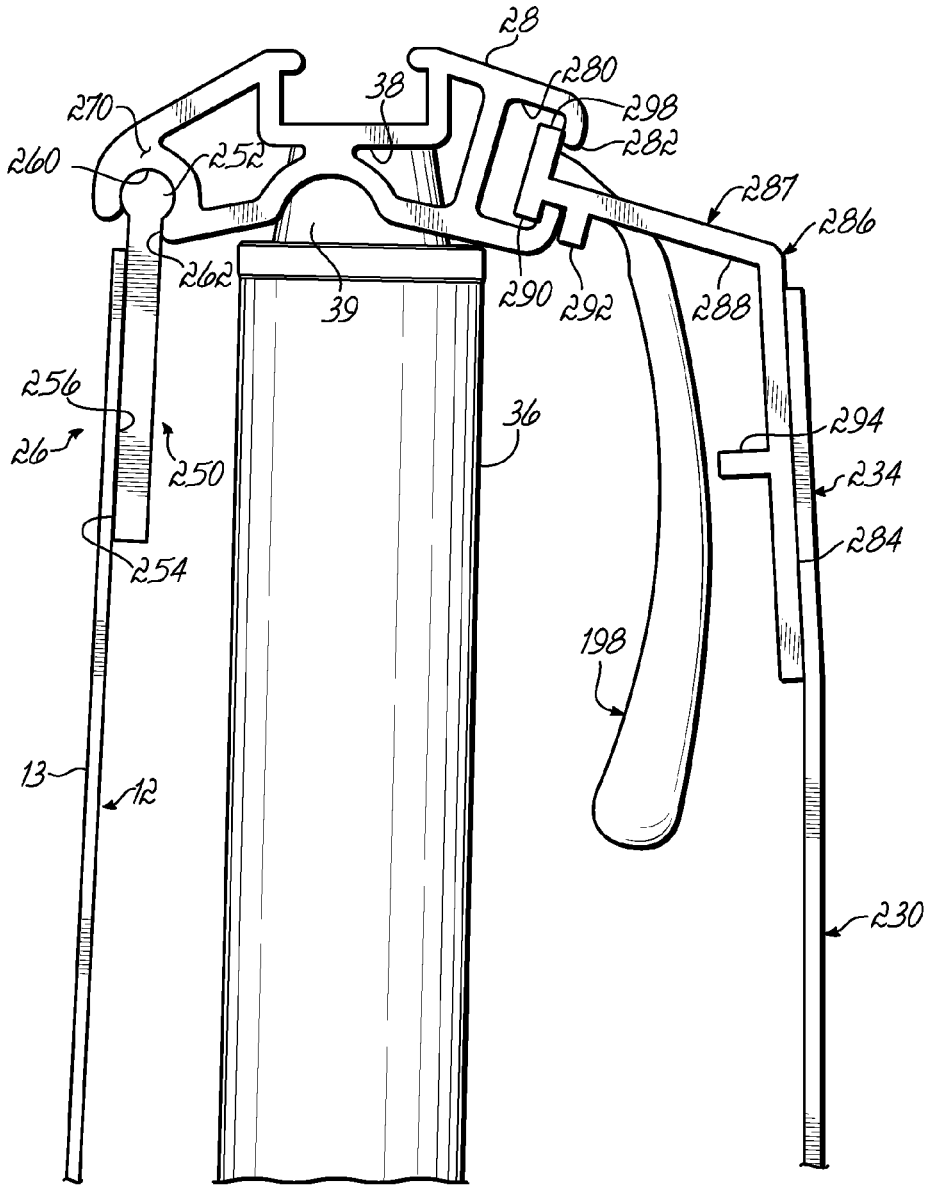
FIG. 26 is a partial, side view of the top of the retractable banner stand and roll up banner of FIG. 24 for purposes of explaining further principles of the present invention.

To facilitate mounting a roll-up banner 230 to top bar 28, top bar 28 may also include a second cylinder 280 extending therealong, but oppositely disposed from cylinder 260. Cylinder 280 may also have an opening or slot 282 running therealong. Cylinder 280 is advantageously rectangular in cross-section with its slot 282 directed outwardly. With further reference to FIGS. 25 and 26, like banner 12, top end 234 of banner 230 may be similarly adhered to a flat face 284 of a mounting member 286. The upper aspect 287 of mounting member 286 defines a generally horizontally oriented shelf 288 terminating in generally vertically oriented tab 290 sized to be slidably received within cylinder 280 through the opening at an end 270 of top bar 28 with shelf 288 extending out through slot 282 to thus mount banner 230 to top bar 28. A vertically depending rib 292 may be provided under shelf 288 and a horizontally extending rib 294 may provided behind flat face 284. Handle 198 of top bar 28 may normally be slidably received within cylinder 280. To mount member 286 to top bar 28, an end cap 278 may be removed and handle 198 slid back out of cylinder 280. Tab 290 of member 286 may then be slid into cylinder 280 and end cap 278 replaced. If handle 198 is still desired, tab 290 of member 286 may be partially inserted into cylinder 280 up to a gap opening 296 in tab 290 and shelf 288 (FIG. 25). Handle 198 may then be inserted, followed by sliding the rest of tab 290 into cylinder 280 (which will slide handle 198 along within gap opening 296), and end cap 278 replaced. Other cross-sectional shapes for tab 290 and/or cylinder 280 could be used if desired. Moreover, depending on the relative dimensions of tab 290, rib 292, cylinder 280 and slot 282, it may be possible to mount member 286 to top bar 28 without removing handle 198. To that end, with gap opening 296 aligned with handle 198, member 288 is angled counter-clockwise to bring the top edge 298 of tab 290 into alignment with slot 282. Top edge 292 is inserted into cylinder 280, followed by rotating tap 290 clockwise through slot 282 to bring tab 290 into the generally vertical orientation, with rib 292 serving to assist in holding tab 290 in place.

By virtue of the foregoing, there is provided a retractable banner display system and method which simplifies banner changes in the field.

While the present invention has been illustrated by a description of an embodiment thereof and specific examples, and while the embodiment has been described in some detail, it is not intended to restrict or in any way limit the scope of the appended claims to such detail. In that regard, while the invention as described has multiple features, which may advantageously be combined, each of those features need not be provided in each embodiment. Additional advantages and modifications will also readily appear to those skilled in the art. For example, pole support 34 may be more permanently attached to or form part of canister 14, such that only the end caps 32 are readily removable to be received on a second canister 14' having its own pole support (releasably engaged therewith, secured thereto, or forming part thereof). Similarly, while kit 30 is shown as having only the pair of end caps 32 and a pole support 34, the pole 36 could also form part of such a kit. Still further, while the present invention is described in the context of changing from banner 12 to banner 12' to display different ads and/or messages, the second canister 14' could contain a banner 12' with the same ad and/or message 13 as in canister 14, but simply new or refreshed in order to replace a worn or damaged banner 12. Also, while end pieces 16 and 17 are shown as separate components secured to the respective normally-open ends 20, 21 of cylinder 14, one or both of those ends could be normally-closed and/or provided with an integral member having the necessary formations to mate with an end cap 32 and/or to allow removal of banner 12 therethrough if desired. The invention in its broader aspects is therefore not limited to the specific details, representative apparatus and methods and illustrative examples shown and described. Accordingly, departures may be made from such details without departing from the scope or spirit of the general inventive concept.

Having described the invention, what is claimed is:

1. A retractable banner display system kit comprising:

a pair of end caps each including a central support element having an inner aspect adapted to releasably engage to and disengage from, without requiring tools, a respective end of a retractable banner canister and a pair of legs extending from opposite sides of the central support element, whereby to selectively support different retractable banner canisters, the central support element having oppositely disposed first and second side edges outboard of the inner aspect and defining a plane therebetween adapted to extend generally transverse to said canister when engaged therewith, each of the pair of legs being foldably coupled to respective ones of the first and second side edges of the central support element and extending when unfolded generally in the plane, and extending when folded generally transverse to the plane and spaced apart whereby to extend generally astride respective opposite surfaces of said canister when the central support is engaged therewith, the end cap further comprising first and second axles coupling the first and second legs, respectively, to the central support element; and a pole support having gripping structure adapted to releasably engage to and disengage from a central aspect of a retractable banner canister whereby a pole mounted to the pole support can hold in an extended state a banner from a said retractable banner canister to which the pair of end caps is engaged.

2. The kit of claim 1, each of the pair of legs extending in opposite directions when unfolded and in generally parallel and spaced apart planes and in generally a same direction when folded.

3. The kit of claim 1, each central support element including a retainer clip adapted to selectively engage an end cap at a respective end of a retractable banner canister.

4. The kit of claim 1, the pole support having a retractable hook adapted to releasably engage a hook receiver in a central aspect of a retractable banner canister whereby to releasably engage the pole support to said canister, and a lever operatively coupled to the hook whereby to selectively retract the hook.

5. The kit of claim 1, the pole support having a cradle shaped to selectively receive a retractable banner canister to which the pole support is to be releasably engaged and a banner tensioning receptacle whereby to selectively support a second banner along with a banner extendable from said canister.

6. The retractable banner display system kit of claim 1, the pole support including a base defining a cradle shaped to selectively receive and seat thereon a retractable banner canister and a pole receiver space adapted to receive an end of a pole.

7. The retractable banner display system kit of claim 6, the base including a hook and a tab spaced from the hook, the tab and hook cooperating to define gripping structure adapted to releasably engage the pole support to said canister.

8. The retractable banner display system kit of claim 6, the base further comprising first and second cooperating banner tensioning receptacles whereby to selectively support a second banner along with a banner extendable from said canister, each of the banner tensioning receptacles defining a vertical slot in the base.

9. A dual banner stand system comprising:

a retractable banner canister;

a retractable first banner extendably supported in the canister and having a generally laterally extending free end;

a generally laterally extending top bar coupled to, and extending generally coextensively with, the free end of the first banner, the top bar being coupled to the freed end of the first banner in an extended state with the banner within the banner canister and an extended state with the banner extending from the banner canister for viewing;

a pole extending to a free end above the canister and adapted to removably hold the top bar with the first banner in the extended state, the top bar adapted to support a second banner whereby when the retractable first banner is held in the extended state, a second banner may be suspended in an extended state from the top bar of the first banner at the same time.

10. The system of claim 9 further comprising a pole support operatively associated with the canister, the pole being held by the pole support, the pole support including a banner tensioning receptacle adapted to receive a banner tensioning cord of a second banner supported by the pole.

11. A method of changing out an extendable banner of a retractable banner stand in which the banner is extendably held in an elongated canister, the method comprising:

removably attaching a first end cap having legs extending therefrom to a first end of a first canister having a first banner extendably held therein and removably attaching a second end cap having legs extending therefrom to a second, opposite end of the first canister, the legs adapted to stabilize the canister on a surface;

removing the first and second end caps from the first canister; and removably attaching the first end cap to a first end of a second canister having a second banner extendably held therein and removably attaching the second end cap to a second, opposite end of the second canister.

12. The method of claim 11 wherein the legs of each end cap fold alongside the canister and unfold to extend transverse thereto, the method including unfolding the legs to support the first canister in a generally horizontal attitude and vertically extending the first banner from the first canister for viewing.

13. The method of claim 12 further comprising folding the legs alongside the first canister with the first banner within the first canister for storage and transport.

14. The method of claim 13 further comprising unfolding the legs to support the second canister in a generally horizontal attitude and vertically extending the second banner from the second canister for viewing.

15. The method of claim 14 further comprising folding the legs alongside the second canister with the second banner within the second canister for storage and transport.

16. The method of claim 11 wherein the legs of each end cap fold alongside the canister and unfold to extend transverse thereto, the method including unfolding the legs to support the second canister in a generally horizontal attitude and vertically extending the second banner from the second canister for viewing.

17. The method of claim 16 further comprising folding the legs alongside the second canister with the second banner within the second canister for storage and transport.

18. The method of claim 11 further comprising:

removably attaching a pole support to the first canister, removably mounting a pole to the pole support whereby to support the banner of the first canister extended in a display position;

removing the pole support from the first canister; and removably attaching the pole support to the second canister whereby to support the second banner of the second canister extended in a display position.

19. The method of claim 18 further comprising removing the pole from the pole support before removably attaching the pole support to the second canister and thereafter removably mounting the pole to the pole support.

20. A method of banner display comprising:

obtaining a canister having a first banner extendably held therein, the first banner having a generally laterally extended free end and a generally laterally extending top bar coupled to, and extending generally coextensive with the free end, to facilitate extending the first banner from an unextended state within the canister to a display position extended from the canister for viewing;

extending the first banner from the canister to the display position;

removably associating the top bar with a free end of a pole to support the first banner in a display position; and coupling an upper end of a second banner to the top bar of the first banner whereby to display the second banner as well.

21. The method of claim 20 further comprising coupling a lower end of the second banner to the canister.

22. The method of claim 21 further comprising coupling the lower end of the second banner to a pole mount associated with the canister to thereby couple the lower end to the canister.

23. A retractable banner display system kit comprising:

a pair of end caps each including a central support element having an inner aspect adapted to releasably engage to and disengage from, without requiring tools, a respective end of a retractable banner canister and a pair of legs extending from opposite sides of the central support element, whereby to selectively support different retractable banner canisters, the central support element having oppositely disposed first and second side edges outboard of the inner aspect and defining a plane therebetween adapted to extend generally transverse to said canister when engaged therewith, each of the pair of legs being foldably coupled to respective ones of the first and second side edges of the central support element and extending when unfolded generally in the plane, and extending when folded generally transverse to the plane and spaced apart whereby to extend generally astride respective opposite surfaces of said canister when the central support is engaged therewith, the end cap further comprising first and second detent members associated with respective edges of the central support member, each of the first and second legs including a pair of detent recessed adapted to selectively receive the detent member of the associated edge therein, the detent recesses positioned to define the leg being folded and unfolded, respectively; and a pole support.

24. The retractable banner display system kit of claim 23, the end cap further comprising a retainer clip associated with the central support inner aspect and operative to releasably attach the central support to said canister.

25. The kit of claim 23, each of the pair of legs extending in opposite directions when unfolded and in generally parallel and spaced apart planes and in generally a same direction when folded.

26. The kit of claim 23, the pole support having a retractable hook adapted to releasably engage a hook receiver in a central aspect of a retractable banner canister whereby to releasably engage the pole support to said canister, and a lever operatively coupled to the hook whereby to selectively retract the hook.

27. The kit of claim 23, the pole support having a cradle shaped to selectively receive a retractable banner canister to which the pole support is to be releasably engaged and a banner tensioning receptacle whereby to selectively support a second banner along with a banner extendable from said canister.

28. The retractable banner display system kit of claim 23, the pole support including a base defining a cradle shaped to selectively receive and seat thereon a retractable banner canister and a pole receiver space adapted to receive an end of a pole.

29. The retractable banner display system kit of claim 28, the base including a hook and a tab spaced from the hook, the tab and hook cooperating to define gripping structure adapted to releasably engage the pole support to said canister.

30. The retractable banner display system kit of claim 28, the base further comprising first and second cooperating banner tensioning receptacles whereby to selectively support a second banner along with a banner extendable from said canister, each of the banner tensioning receptacles defining a vertical slot in the base.

31. A retractable banner display system kit comprising:

a pair of end caps each including a central support element having an inner aspect adapted to releasably engage to and disengage from, without requiring tools, a respective end of a retractable banner canister and a pair of legs extending from opposite sides of the central support element, whereby to selectively support different retractable banner canisters, the central support element having oppositely disposed first and second side edges outboard of the inner aspect and defining a plane therebetween adapted to extend generally transverse to said canister when engaged therewith, each of the pair of legs being foldably coupled to respective ones of the first and second side edges of the central support element and extending when unfolded generally in the plane, and extending when folded generally transverse to the plane and spaced apart whereby to extend generally astride respective opposite surfaces of said canister when the central support is engaged therewith, the end cap further comprising a core locking pin removably supported with the central support; and a pole support.

32. The retractable banner display system kit of claim 31, the end cap further comprising a retainer clip associated with the central support inner aspect and operative to releasably attach the central support to said canister, the core locking pin being removably supported by the retainer clip.

33. The kit of claim 31, each of the pair of legs extending in opposite directions when unfolded and in generally parallel and spaced apart planes and in generally a same direction when folded.

34. The kit of claim 31, the pole support having a retractable hook adapted to releasably engage a hook receiver in a central aspect of a retractable banner canister whereby to releasably engage the pole support to said canister, and a lever operatively coupled to the hook whereby to selectively retract the hook.

35. The kit of claim 31, the pole support having a cradle shaped to selectively receive a retractable banner canister to which the pole support is to be releasably engaged and a banner tensioning receptacle whereby to selectively support a second banner along with a banner extendable from said canister.

36. The retractable banner display system kit of claim 31, the pole support including a base defining a cradle shaped to selectively receive and seat thereon a retractable banner canister and a pole receiver space adapted to receive an end of a pole.

37. The retractable banner display system kit of claim 36, the base including a hook and a tab spaced from the hook, the tab and hook cooperating to define gripping structure adapted to releasably engage the pole support to said canister.

38. The retractable banner display system kit of claim 36, the base further comprising first and second cooperating banner tensioning receptacles whereby to selectively support a second banner along with a banner extendable from said canister, each of the banner tensioning receptacles defining a vertical slot in the base.

* * * * *